US010001036B2

(12) United States Patent
Smith et al.

(10) Patent No.: US 10,001,036 B2
(45) Date of Patent: Jun. 19, 2018

(54) VARIABLE CAMSHAFT TIMING MECHANISM WITH A LOCK PIN ENGAGED BY OIL PRESSURE

(71) Applicant: BorgWarner Inc., Auburn Hills, MI (US)

(72) Inventors: Franklin R. Smith, Cortland, NY (US); Daniel Brown, Freeville, NY (US)

(73) Assignee: BORGWARNER INC., Auburn Hills, MI (US)

( * ) Notice: Subject to any disclaimer, the term of this patent is extended or adjusted under 35 U.S.C. 154(b) by 30 days.

(21) Appl. No.: 14/899,684

(22) PCT Filed: Jun. 5, 2014

(86) PCT No.: PCT/US2014/041000
§ 371 (c)(1),
(2) Date: Dec. 18, 2015

(87) PCT Pub. No.: WO2014/204650
PCT Pub. Date: Dec. 24, 2014

(65) Prior Publication Data

US 2016/0130988 A1 May 12, 2016

Related U.S. Application Data

(60) Provisional application No. 61/836,830, filed on Jun. 19, 2013, provisional application No. 61/974,613, filed on Apr. 3, 2014.

(51) Int. Cl.
*F01L 1/34* (2006.01)
*F01L 1/344* (2006.01)
(Continued)

(52) U.S. Cl.
CPC ..... *F01L 1/34* (2013.01); *F01L 1/044* (2013.01); *F01L 1/047* (2013.01); *F01L 1/3442* (2013.01);
(Continued)

(58) Field of Classification Search
CPC . F01L 1/3442; F01L 2001/34423; F01L 1/34; F01L 2001/34459; F01L 2001/34463; F01L 2001/34466
(Continued)

(56) References Cited

U.S. PATENT DOCUMENTS 4,627,825 A 12/1986 Bruss et al.
4,858,572 A 8/1989 Shirai et al.
(Continued)

FOREIGN PATENT DOCUMENTS

CN 1495344 A 5/2004
CN 1755066 A 4/2006
(Continued)

OTHER PUBLICATIONS

International Search Report of PCT/US2014/041000 dated Oct. 2, 2014.
(Continued)

*Primary Examiner* — Ching Chang
(74) *Attorney, Agent, or Firm* — Brown & Michaels, PC

(57) ABSTRACT

A hydraulically operated camshaft phasing mechanism has two lock pins. One of the lock pins engages at an intermediate position and an end lock pin engages near one of the stops at the end of the phaser range of authority. At least one of the locking pins, preferably the end lock pin, when the vane is at an end stop position, is engaged by oil pressure and spring loaded to release when the oil pressure side of the end lock pin is vented.

35 Claims, 19 Drawing Sheets

(51) Int. Cl.
*F01L 1/04* (2006.01)
*F01L 1/047* (2006.01)

(52) U.S. Cl.
CPC ..... *F01L 2001/34423* (2013.01); *F01L 2001/34446* (2013.01); *F01L 2001/34459* (2013.01); *F01L 2001/34463* (2013.01); *F01L 2001/34466* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 5,002,023 | A | 3/1991 | Butterfield et al. | |
| 5,107,804 | A | 4/1992 | Becker et al. | |
| 5,497,738 | A | 3/1996 | Siemon et al. | |
| 5,657,725 | A | 8/1997 | Butterfield et al. | |
| 5,738,056 | A | 4/1998 | Mikame et al. | |
| 5,797,361 | A | 8/1998 | Mikame et al. | |
| 5,924,395 | A | 7/1999 | Moriya et al. | |
| 6,170,448 | B1 | 1/2001 | Asakura | |
| 6,302,072 | B1 | 10/2001 | Sekiya et al. | |
| 6,311,655 | B1 | 11/2001 | Simpson et al. | |
| 6,374,787 | B2 | 4/2002 | Simpson et al. | |
| 6,453,856 | B1 | 9/2002 | Lehmann et al. | |
| 6,453,859 | B1 | 9/2002 | Smith et al. | |
| 6,481,402 | B1 | 11/2002 | Simpson et al. | |
| 6,526,930 | B2 | 3/2003 | Takahashi et al. | |
| 6,666,181 | B2 | 12/2003 | Smith et al. | |
| 6,684,835 | B2 | 2/2004 | Komazawa et al. | |
| 6,745,735 | B2 | 6/2004 | Smith | |
| 6,763,791 | B2 | 7/2004 | Gardner et al. | |
| 6,779,499 | B2 | 8/2004 | Takenaka et al. | |
| 6,814,038 | B2 | 11/2004 | Smith | |
| 6,941,913 | B2 | 9/2005 | Smith | |
| 7,000,580 | B1 | 2/2006 | Smith et al. | |
| 7,137,371 | B2 | 11/2006 | Simpson et al. | |
| 7,194,992 | B2 * | 3/2007 | Smith ..... | F01L 1/34 123/90.17 |
| 7,240,651 | B1 | 7/2007 | Hanshaw | |
| 7,270,096 | B2 | 9/2007 | Lancefield et al. | |
| 7,444,968 | B2 | 11/2008 | Lancefield et al. | |
| 7,527,028 | B2 | 5/2009 | Leone | |
| 7,669,566 | B2 | 3/2010 | Methley | |
| 7,765,955 | B2 | 8/2010 | Brooks et al. | |
| 7,765,966 | B2 | 8/2010 | Leone | |
| 7,934,479 | B2 | 5/2011 | Strauss | |
| 8,006,660 | B2 | 8/2011 | Strauss et al. | |
| 8,011,337 | B2 | 9/2011 | Hayashi | |
| 8,028,667 | B2 | 10/2011 | Hayashi | |
| 8,047,170 | B2 | 11/2011 | Strauss et al. | |
| 8,069,829 | B2 | 12/2011 | Leone | |
| 8,356,583 | B2 | 1/2013 | Smith | |
| 8,794,202 | B2 | 8/2014 | Suzuki et al. | |
| 8,893,677 | B2 | 11/2014 | Smith | |
| 2002/0043230 | A1 | 4/2002 | Kinugawa | |
| 2003/0121486 | A1 | 7/2003 | Komazawa et al. | |
| 2005/0103297 | A1 | 5/2005 | Simpson | |
| 2005/0229880 | A1 | 10/2005 | Hashizume | |
| 2006/0086332 | A1 | 4/2006 | Simpson et al. | |
| 2007/0215084 | A1 | 9/2007 | Pluta et al. | |
| 2010/0139593 | A1 | 6/2010 | Takemura | |
| 2010/0251981 | A1 | 10/2010 | McCloy et al. | |
| 2011/0011358 | A1 | 1/2011 | Child | |
| 2011/0017156 | A1 | 1/2011 | Smith | |
| 2012/0145098 | A1 | 6/2012 | Crowe et al. | |
| 2013/0008399 | A1 | 1/2013 | Busse et al. | |

FOREIGN PATENT DOCUMENTS

| | | | |
|---|---|---|---|
| CN | 101046165 | A | 10/2007 |
| GB | 2278661 | A | 12/1994 |
| GB | 2437305 | | 10/2007 |
| GB | 2432645 | B | 12/2010 |
| JP | 02149707 | A | 6/1990 |
| JP | 09280017 | A | 10/1997 |
| JP | 11-210424 | | 8/1999 |
| JP | 2000230511 | A | 8/2000 |
| JP | 2000320356 | A | 11/2000 |
| JP | 2001-098910 | | 4/2001 |
| JP | 2002309975 | A | 10/2002 |
| JP | 2007138744 | A | 6/2007 |
| JP | 2008069735 | A | 3/2008 |
| JP | 2011513651 | A | 4/2011 |
| JP | 2013538981 | A | 10/2013 |
| WO | 2009114500 | A1 | 9/2009 |
| WO | 2012047748 | A2 | 4/2012 |

OTHER PUBLICATIONS

Office Action for Japanese Patent Application No. 2015-563191 received from the Japanese Patent Office dated Jul. 5, 2016, with attached English machine translation.
International Search Report for PCT/US2011/054196; dated May 7, 2012; 9 pages.
International Search Report for PCT/US2009/036611 dated Aug. 20, 2009; 10 pgs.
Staub, A. et al.; Quo vadis hydraulic variable camshaft phasing unit?; 2010; pp. 215-225.
Miura, T. et al.; Development of a Hydraulic Variable Valve Timing Control System with an Optimum Angular Position Locking Mechanism; SAE International; 2012; 14 pag.
International PCT Search Report for PCT/US2014/023838 dated Aug. 26, 2014; 12 pgs.

* cited by examiner

VARIABLE CAMSHAFT TIMING MECHANISM WITH A LOCK PIN ENGAGED BY OIL PRESSURE

BACKGROUND OF THE INVENTION

Field of the Invention

The invention pertains to the field of variable cam timing. More particularly, the invention pertains to a variable camshaft timing mechanism with at least one lock pin engaged by oil pressure.

Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in the figures, vane phasers have a rotor 105 with one or more vanes 104, mounted to the end of the camshaft, surrounded by a housing assembly 100 with the vane chambers into which the vanes fit. It is possible to have the vanes 104 mounted to the housing assembly 100, and the chambers in the rotor assembly 105, as well. The housing's outer circumference 101 forms the sprocket, pulley or gear accepting drive force through a chain, belt, or gears, usually from the crankshaft, or possibly from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operates under a similar principle with the exception that it has one or more check valves to prevent the VCT phaser from moving in a direction opposite than being commanded, should it incur an opposing force such as a torque impulse caused by cam operation.

The auto industry has determined there are multiple strategies that can be used with an intake camshaft phasing mechanism. For example, a camshaft phaser locked at some intermediate start position is best for cold engine start emissions. An intake camshaft phaser commanded to full retard position is best for improved fuel economy during engine operation.

The problem with OPA or TA systems in executing the strategies discussed above is that the oil control valve defaults to a position that exhausts all the oil from either the advance or retard working chambers and fills the opposing chamber. In this mode, the phaser defaults to moving in one direction to an extreme stop where the lock pin engages. A bias spring may be used to preferentially guide the phaser to a desired position. The OPA or TA systems are unable to direct the VCT phaser to any other position during the engine start cycle when the engine is not developing any oil pressure. This limits the phaser to being able to move in one direction only in the engine shut down mode. In the past this was acceptable because at engine shut down and during engine start the VCT phaser would be commanded to lock at one of the extreme travel limits (either full advance or full retard).

Furthermore, by reducing the idling time of an internal combustion engine in a vehicle, the fuel efficiency is increased and emissions are reduced. Therefore, vehicles can use a "stop-start mode" which automatically stops and automatically restarts the internal combustion engine to reduce the amount of time the engine spends idling when the vehicle is stopped, for example at a stop light or in traffic. This stopping of the engine is different than a "key-off" position or manual stop via deactivation of the ignition switch in which the user of the vehicle shuts the engine down or puts the car in park and shuts the vehicle off. In "stop-start mode", the engine stops as the vehicle is stopped, then automatically restarts in a manner that is nearly undetectable to the user of the vehicle. During "stop-start", it has been determined that the full retard phaser position reduces the energy required to start the engine and the full retard phase position reduces the engine Noise Vibration and Harshness (NVH) during a hot engine restart. Other strategies may be developed that require a different lock position than described.

The problem with an intake camshaft phaser design that has an extended range of authority and the ability to lock at the full retard stop is that if the engine is shut down with the intake camshaft phaser locked at or near the retard stop and the engine is allowed to cool down, then the engine may not be able to accomplish a successful cold start with the phaser locked near the retard stop. Therefore, it is desirable for the phaser to be unlocked and repositioned to the mid lock position during engine cranking A typical hydraulic operated camshaft phaser uses a spring force to engage the lock pin and engine oil pressure to release the lock pin. However, during engine cranking there may not be sufficient engine oil pressure to release the lock pin.

SUMMARY OF THE INVENTION

In some embodiments, hydraulically operated camshaft phasing mechanisms have two lock pins. One of the lock pins engages at an intermediate position and an end lock pin engages near one of the stops at the advance or retard end of the phaser range of authority. At least one of the locking pins, preferably the end lock pin at the retard stop, is engaged by oil pressure and spring loaded to release when the oil pressure side of the end lock pin is vented.

In an alternate embodiment, an accumulator may be in fluid communication with the lock pin switching circuit to increase the time in which the end lock pin is engaged after engine shut down.

In an embodiment, the end lock pin releases before engine oil pressure is developed in the engine so the phaser can be repositioned during engine cranking to a more optimal position for a cold engine start, while maintaining a locked state when cranking during "stop-start".

In another embodiment, a single lock pin is present which engages near one of the stops at the advance end or the retard end of the phaser's range.

DETAILED DESCRIPTION OF THE INVENTION

Figure 1:
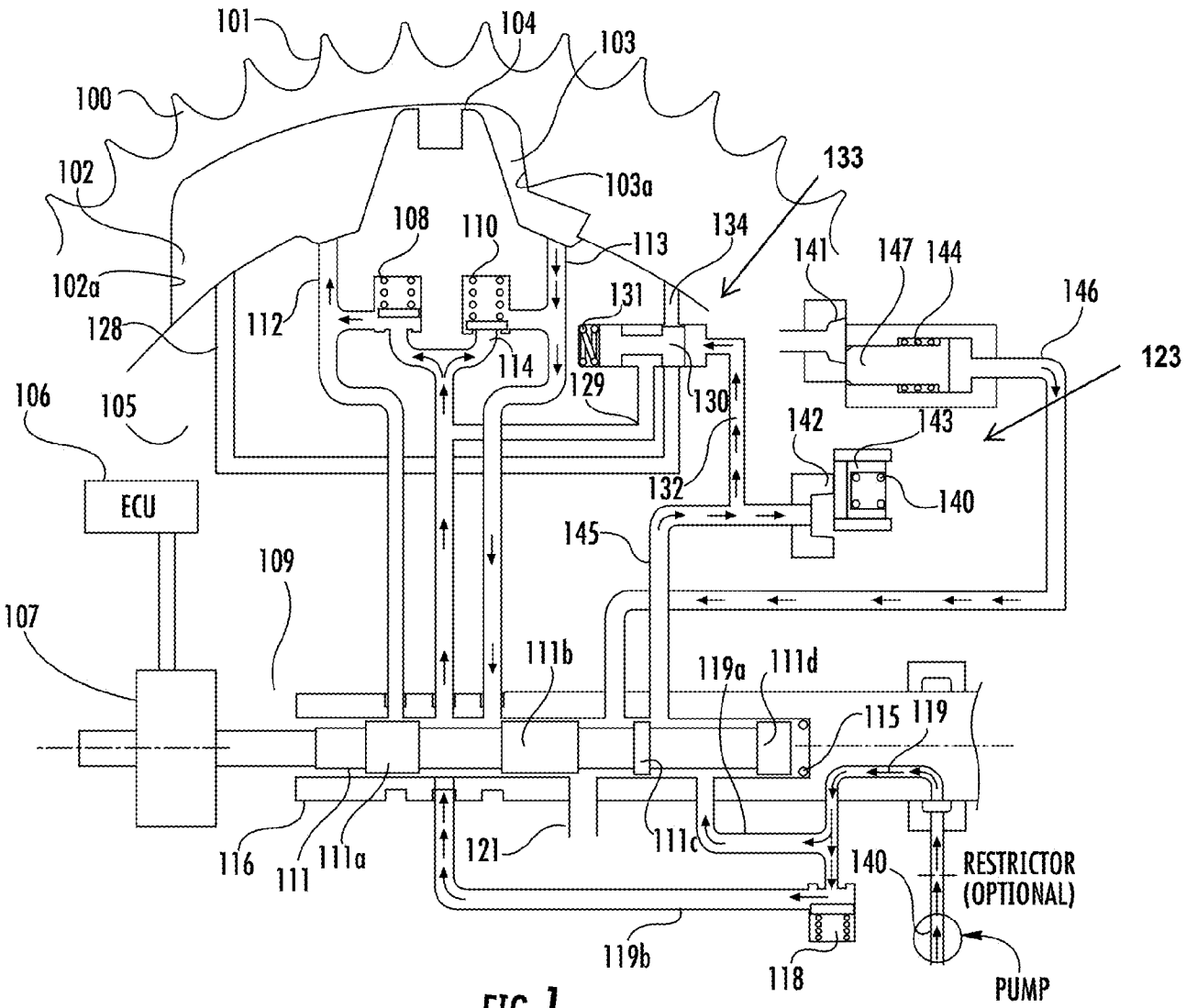
FIG. 1 shows a schematic of a cam torque actuated (CTA) phaser of a first embodiment moving towards an advance position.

A hydraulically operated camshaft phasing mechanism of an embodiment has two lock pins, one of which is engaged by engine oil pressure before engine shut down and released by spring force which acts when the locking pin is vented to atmosphere, relieving the oil pressure. The other lock pin is engaged by spring force and released by oil pressure once the engine is running In an alternate embodiment, an accumulator may be in fluid communication with the lock pin switching circuit to increase the time in which the end lock pin is engaged after engine shut down.

In the embodiments described, the end lock pin is released before engine oil pressure is developed in the engine so the phaser can be repositioned during engine cranking to a more optimal position for a cold engine start.

In some embodiments, the control valve that controls the position and rate of actuation of the camshaft phasing mechanism or phaser also has a portion of the control valve that controls the lock pin switching function. In addition this same hydraulic circuit can be used to control a hydraulic detent valve that causes the camshaft phasing mechanism to find an intermediate locked position.

Although in some embodiments the end lock pin that was engaged by pressure was at the retard stop, the same concept could be used for locking at any other position within the range of authority of the phaser.

In some embodiments, a phaser, which has an offset or remote piloted valve added to the hydraulic circuit aids in managing a hydraulic detent switching function, which provides a mid-position lock for cold starts of the engine, either during cranking or prior to complete engine shutdown is used. The mid-position locking of the phaser positions the cam at an optimum position for cold restarts of the engine once a current signal has been removed from the actuator, or variable force solenoid. The phaser may also be locked in a full retard position during an automatic "stop" of the engine in stop-start mode.

In some embodiments, the phasers have two lock pins. Both the lock pins may engage the outer end plate of the housing assembly when in a locked position, engage the inner end plate of the housing assembly when in a locked position or be split such that an intermediate lock pin, which in a locking position, engages an outer end plate of the housing assembly of the phaser and an end lock pin, which in a locking position, engages with the inner end plate of the housing assembly. In one embodiment, one of the lock pins is moved to a locked position when the phaser is in a full retard position and the other of the lock pins is moved to a locked position when the phaser is in a mid-position or intermediate phase angle. Alternatively, one of the lock pins is moved to a locked position when the phaser is in a full advance position and the other of the lock pins is moved to a locked position when the phaser is in a mid-position or intermediate phase angle. In another alternate embodiment, one of the lock pins may be moved to a locked position when the phaser is in a full advance position and the other of the lock pins may be moved to a locked position when the phaser is in a full retard position.

In other embodiments, the phasers have a lock pin that engages the outer end plate of the housing assembly when in a locked position or the inner end plate of the housing assembly when in a locked position, locking the rotation of the housing relative to the rotor. The lock pin preferably moves to a locked position when the phaser is in a full retard position. In order to move the lock pin to a locked position, pressure is required to move the body of the lock pin, against the force of a spring, into engagement of the outer end plate of the housing assembly or the inner end plate of the housing assembly depending on where the lock pin is located.

The piloted valve may be controlled on/off with the same hydraulic circuit that engages or releases one of the two lock pins. This shortens the variable cam timing (VCT) control valve to two hydraulic circuits, a VCT control circuit and a combined lock pin/hydraulic detent control circuit. Movement of the piloted valve to the first position is actively controlled by the remote on/off valve or the control valve of the phaser.

One of the advantages to using the remote piloted valve is that it can have a longer stroke than the control valve, since it is not limited by a solenoid. Therefore, the piloted valve can open up a larger flow passage for the hydraulic detent mode and improve actuation rate in the detent mode. In addition, the location of the remote piloted valve shortens and simplifies the hydraulic detent circuit and thereby increases performance of the VCT detent mode or intermediate phase angle position of the phaser.

FIGS. 1-5 show the operating modes of a CTA VCT phaser depending on the spool valve position. The positions shown in the figures define the direction the VCT phaser is moving to. It is understood that the phase control valve has an infinite number of intermediate positions, so that the control valve not only controls the direction the VCT phaser moves, but depending on the discrete spool position, controls the rate at which the VCT phaser changes positions. Therefore, it is understood that the phase control valve can also operate in infinite intermediate positions and is not limited to the positions shown in the Figures.

Referring to FIGS. 1-5, torque reversals in the camshaft caused by the forces of opening and closing engine valves move the vane 104. The advance and retard chambers 102, 103 are arranged to resist positive and negative torque pulses in the camshaft and are alternatively pressurized by the cam torque. The control valve 109 allows the vane 104 in the phaser to move by permitting fluid flow from the advance chamber 102 to the retard chamber 103 or vice versa, depending on the desired direction of movement.

The housing assembly 100 of the phaser has an outer circumference 101 for accepting drive force, an inner end plate (not shown) and an outer end plate (not shown). The rotor assembly 105 is connected to the camshaft and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic detent circuit 133 and a lock pin circuit 123 are also present. The hydraulic detent circuit 133 and the lock pin circuit 123 are essentially one circuit as discussed above, but will be discussed separately for simplicity.

The hydraulic detent circuit 133 includes a spring 131 loaded piloted valve 130 and an advance detent line 128 that connects the advance chamber 102 to the piloted valve 130 and the common line 114, and a retard detent line 134 that connects the retard chamber 103 to the piloted valve 130, line 129 connected to the piloted valve 130 and the common line 114. The advance detent line 128 and the retard detent line 134 are a predetermined distance or length from the vane 104. The piloted valve 130 is in the rotor assembly 105 and is fluidly connected to the lock pin circuit 123 and line 119*a* through line 132. The lock pin circuit 123 includes an intermediate lock pin 143, an intermediate lock pin spring 139, line 132, the piloted valve 130, supply line 119*a*, line 145, exhaust line 121, line 146, the end lock pin 147, and the end lock pin spring 144.

The intermediate lock pin 143 and the end lock pin 147 are slidably housed in bores in the rotor assembly 105 and more preferably in the vane 104. An end portion of the intermediate lock pin 143 is spring biased towards and fits into a recess 142 in an end plate of the housing assembly 100 by an intermediate lock pin spring 139. An end portion of the end lock pin 147 is spring biased away from the recess 141 or hydraulically biased towards and fits into a recess 141 in an end plate of the housing assembly 100. The opening and closing of the hydraulic detent circuit 133 and pressurization of the lock pin circuit 123 are both controlled by the switching/movement of the phase control valve 109.

Figure 2:
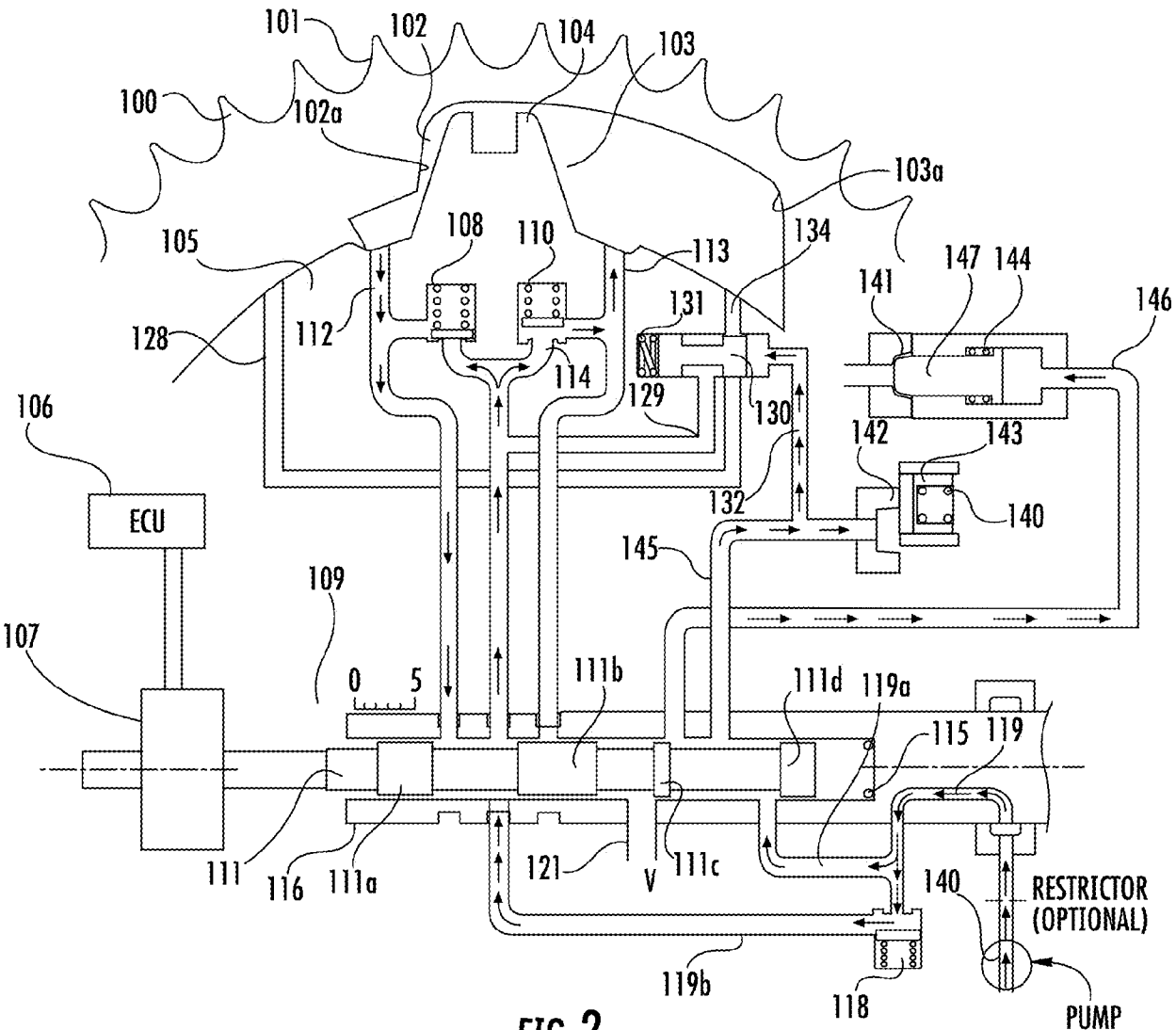
FIG. 2 shows a schematic of a cam torque actuated (CTA) phaser of a first embodiment in a full stop retard position with an end lock pin in a locked position, locking the phaser.
Figure 4:
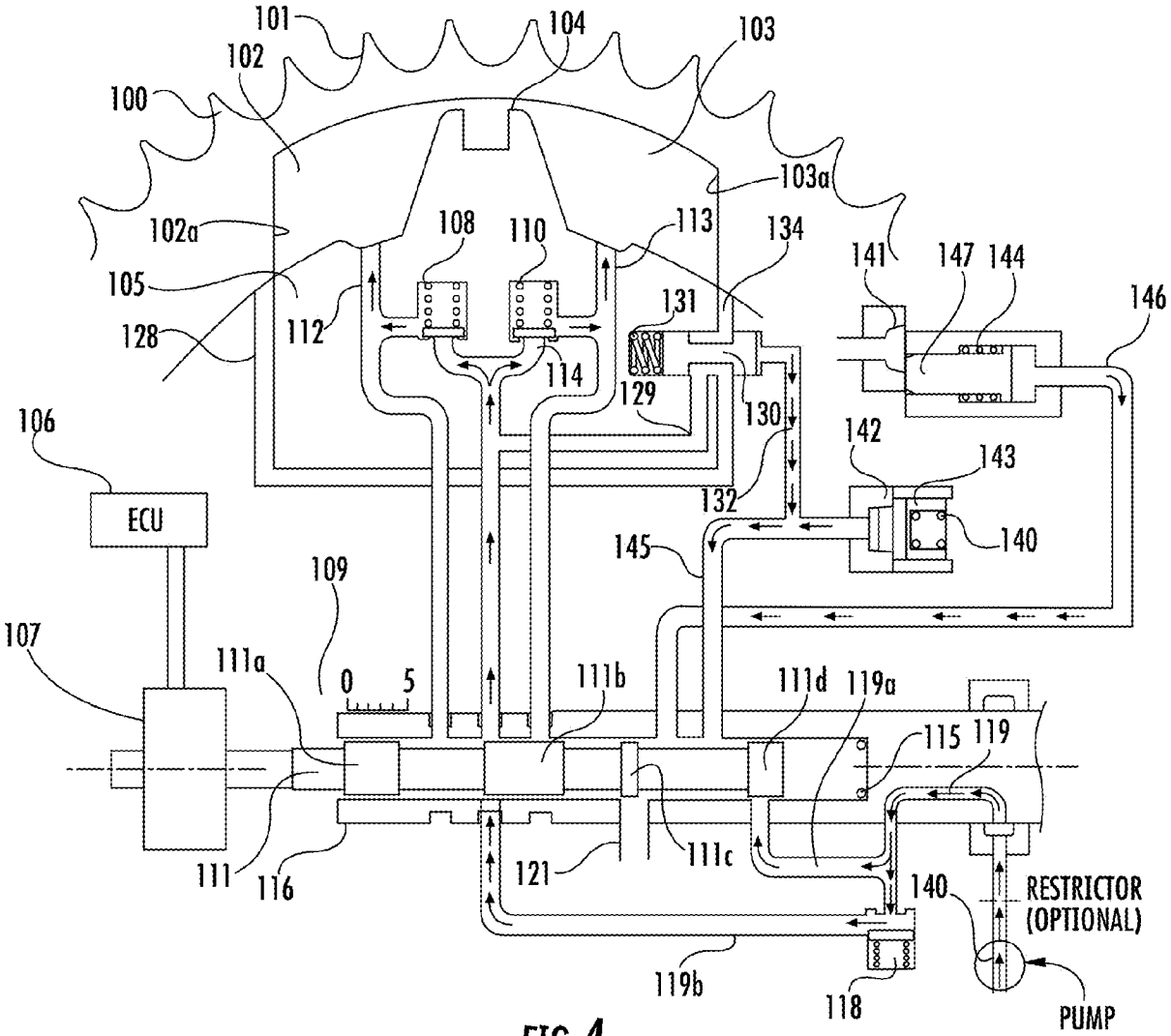
FIG. 4 shows a schematic of a cam torque actuated (CTA) phaser of a first embodiment with a hydraulic circuit in an open position and the intermediate lock pin in a locked position, locking the phaser.

While the intermediate lock pin 143 and the end lock pin 147 are part of the overall lock pin circuit 123, there are independent modes in which the end lock pin 147 is vented, while the intermediate lock pin is pressurized or filled. For example, when the spool is full in, or moving towards the advance position as shown in FIG. 1, the intermediate lock pin 143 is pressurized or filled and the end lock pin 147 is vented or not filled. During low duty cycle, the intermediate lock pin 143 is pressurized or filled and the end lock pin is also pressurized or filled as shown in FIG. 2. During 0% duty cycle, the intermediate lock pin 143 and the end lock pin are both vented or not filled as shown in FIG. 4.

A control valve 109, preferably a spool valve, includes a spool 111 with cylindrical lands 111*a*, 111*b*, 111*c*, 111*d* slidably received in a sleeve 116. The control valve may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators in place of the variable force solenoid 107.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, the retard position or the retard lock position) of the phaser as well as whether the lock pin circuit 123 and the hydraulic detent circuit 133 are open (on) or closed (off) and whether the intermediate lock pin 143 or end lock pin 147 is in a locked or unlocked position. In other words, the position of the spool 111 actively controls the piloted valve 130. The control valve 109 has an advance mode, a retard mode, a retard lock mode, a null mode (holding position), and a detent mode.

In the advance mode, the spool 111 is moved to a position so that fluid may flow from the retard chamber 103 through the spool 111 to the advance chamber 102, fluid is blocked from exiting the advance chamber 102, and the detent valve circuit 133 is off or closed. Both of the lock pins 147, 143 are in an unlocked position.

In the retard mode, the spool 111 is moved to a position so that fluid may flow from the advance chamber 102 through the spool 111 to the retard chamber 103, fluid is blocked from exiting the retard chamber 103, and the detent valve circuit 133 is off and both of the lock pins 147, 143 are in an unlocked position.

In null mode, the spool 111 is moved to a position that blocks the exit of fluid from the advance and retard chambers 102, 103, and the detent valve circuit 133 is off.

In the retard locking mode or end stop lock mode, the vane 104 has already been moved to a full retard position and flow from the advance chamber 102 through the spool 111 to the retard chamber continues with fluid blocked from exiting the retard chamber 103. In this mode, the detent circuit is off, and the end lock pin 147 is pressurized, thus causing the end lock pin spring 144 to compress and allow the end lock pin 147 to engage the recess 141 of an end plate and move to a locked position. The "full retard position" is defined as when the vane 104 contacts the advance wall 102*a* of the chamber 117 or is substantially close to the advance wall 102*a* and may be referred to as a "retard end stop position" of the vane.

In the detent mode, three functions occur. The first function in the detent mode is that the spool 111 moves to a position in which spool land 111*b* blocks the flow of fluid from line 112 in between spool lands 111*a* and 111*b* from entering any of the other lines and line 113, effectively removing control of the phaser from the control valve 109. The second function in detent mode is to open or turn on the detent valve circuit 133. The detent valve circuit 133 has complete control over the phaser moving to advance or retard, until the vane 104 reaches the intermediate phase angle position. The third function in the detent mode is to vent the lock pin circuit 123, allowing the intermediate lock pin 143 to engage the recess 142 in an end plate of the housing assembly 100. It should be noted that the end lock pin 147 is also vented and is spring biased by the end lock pin spring 144 to an unlocked position. The intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 111 moves to a corresponding position along its stroke. When the duty cycle of the variable force solenoid 107 is approximately 40%, 60%, and greater than 60%, the spool 111 will be moved to positions that correspond with the retard mode/retard locking mode, the null mode (holding position), and the advance mode, respectively and the piloted valve 130 will be pressurized and moves to and remains in a first position, the hydraulic detent circuit 133 will be closed, and the intermediate lock pin 143 will be pressurized and released to an unlocked position. In the retard locking mode or end stop lock mode, the end lock pin 147 is pressurized and engages the recess 141 of an end plate of the housing assembly 100.

When the duty cycle of the variable force solenoid 107 is 0%, the spool 111 is moved to the detent mode such that the piloted valve 130 vents and moves to a second position, the hydraulic detent circuit 133 will be open, and the intermediate lock pin 143 vented and engaged with the recess 142. The end lock pin 147 is also vented through line 146 to exhaust line 121, such that the end lock pin spring 144 biases the end lock pin 147 out of engagement with the recess 141 and is therefore in an unlocked position. A duty cycle of 0% was chosen as the extreme position along the spool stroke to open the hydraulic detent circuit 133, vent the piloted valve 130, and vent and engage the intermediate lock pin 143 with the recess 142, since if power or control is lost, the phaser will default to a locked position. It should be noted that the duty cycle percentages listed above are an example and they may be altered. Furthermore, the hydraulic detent circuit 133 may be open, the piloted valve 130 vented, and the intermediate lock pin 143 vented and engaged with the recess 142 at 100% duty cycle, if desired.

When the duty cycle is set to be greater than 60%, the vane of the phaser is moving toward and/or in an advance position. The stroke of the spool or position of the spool relative to the sleeve is between 3.5 and 5 mm for the advance position.

FIG. 1 shows the phaser moving towards the advance position. To move towards the advance position, the duty cycle is increased to greater than 60%, the force of the VFS 107 on the spool 111 is increased and the spool 111 is moved to the right by the VFS 107 in an advance mode, until the force of the spring 115 balances the force of the VFS 107.

In the advance mode shown, spool land 111*a* blocks line 112 and lines 113 and 114 are open. Camshaft torque pressurizes the retard chamber 103, causing fluid to move from the retard chamber 103 and into the advance chamber 102, and the vane 104 to move towards the retard wall 103*a*. Fluid exits from the retard chamber 103 through line 113 to the control valve 109 between spool lands 111*a* and 111*b* and recirculates back to central line 114 and line 112 leading to the advance chamber 102.

Makeup oil is supplied to the phaser from supply S by pump 140 to make up for leakage and enters line 119. If the control valve 109 is in the camshaft, line 119 may be drilled through a bearing. Line 119 splits into two lines 119*a* and 119*b*.

Line 119*b* leads to an inlet check valve 118 and the control valve 109. From the control valve 109, fluid enters line 114 through the advance check valves 108 and flows to the advance chamber 102.

Line 119*a* leads to two different lines, line 146 to the end lock pin 147 and to line 145 to the intermediate lock pin 143. Line 145 further branches into line 132 which leads to the piloted valve 130. The pressure of the fluid in line 119*a* moves through the spool 111 between lands 111*c* and 111*d* into line 145 to bias the intermediate lock pin 143 against the intermediate lock pin spring 139 to a released position. The fluid in line 145 also flows through line 132 and pressurizes the piloted valve 130 against the spring 131, moving the piloted valve 130 to a position where retard detent line 134, advance detent line 128 and line 129 are blocked as shown in FIG. 1 and the detent circuit is off. At the same time, fluid from line 146 in fluid communication with the end lock pin 147, is vented to exhaust line 121, such that the end lock pin spring 144 biases the end lock pin 147 out of engagement with the recess 141 and is therefore in an unlocked position. Exhaust line 121 is blocked by spool land 111*c* preventing line 145 from venting. Spool land 111*b* prevents fluid from line 113 from venting through exhaust line 121.

When the duty cycle is set between 40-60%, the vane of the phaser is moving toward and/or in a retard position. The stroke of the spool or position of the spool relative to the sleeve is between 2 and 3.5 mm for the retard position.

Figure 5:
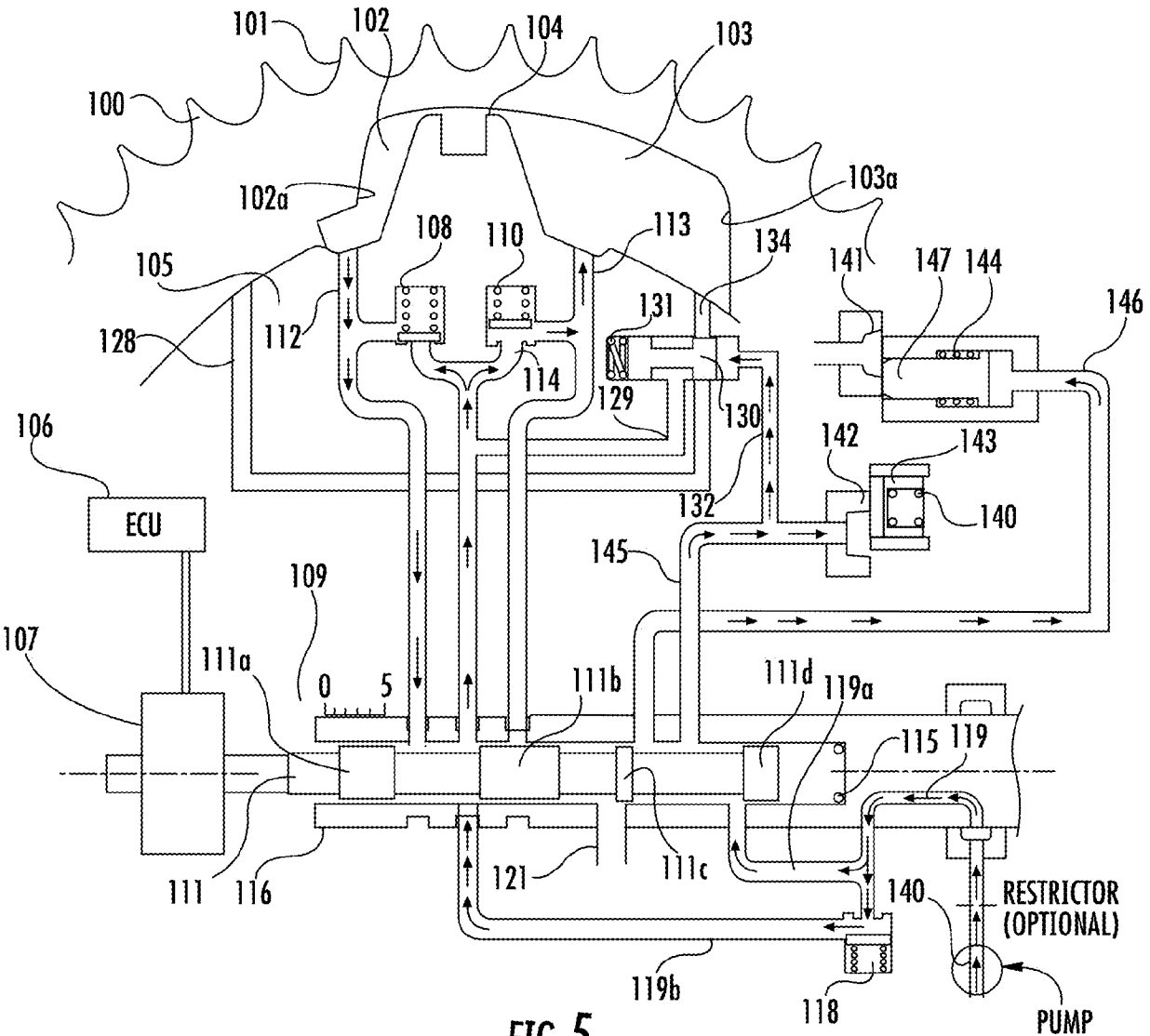
FIG. 5 shows a schematic of a cam torque actuated (CTA) phaser of a first embodiment moving towards a retard position.

FIG. 5 shows the phaser moving towards the retard position. To move towards the retard position, the duty cycle is changed to greater than 40% but less than 60%, the force of the VFS 107 on the spool 111 is reduced and the spool 111 is moved by spring 115, until the force of spring 115 balances the force of the VFS 107. In the retard mode, spool land 111*b* blocks line 113 and lines 112 and 114 are open.

Camshaft torque pressurizes the advance chamber 102, causing fluid in the advance chamber 102 to move into the retard chamber 103, and the vane 104 to move towards the advance chamber wall 102*a*. Fluid exits from the advance chamber 102 through line 112 to the control valve 109 between spool lands 111*a* and 111*b* and recirculates back to central line 114 and line 113 leading to the retard chamber 103.

Makeup oil is supplied to the phaser from supply S by pump 140 to make up for leakage and enters line 119. Line 119 splits into two lines 119*a* and 119*b*. Line 119*b* leads to an inlet check valve 118 and the control valve 109. From the control valve 109, fluid enters line 114 through the retard check valve 110 and flows to the retard chamber 103. Line 119*a* leads to two different lines, line 146 to the end lock pin 147 and to line 145 to the intermediate lock pin 143. Line 145 further branches into line 132 which leads to the piloted valve 130. The pressure of the fluid in line 119*a* moves through the spool 111 between lands 111*c* and 111*d* into line 145 to bias the intermediate lock pin 143 against the intermediate lock pin spring 139 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked and the detent circuit is off. Line 146, is partially open to exhaust line 121 between spool lands 111*c* and 111*d*. The end lock pin 147 will remain partially biased against the spring 144 in a released position until the recess 141 of the end plate aligns with the end lock pin 147 as shown in FIG. 2. Exhaust line 121 is blocked by spool land 111*c*, preventing lines 145 and 146 from venting.

When the duty cycle is set between 40-60%, the vane of the phaser is moving toward and/or in a retard locking position. The stroke of the spool or position of the spool relative to the sleeve is approximately 2 mm for the retard locking position.

FIG. 2 shows the phaser in the retard locking position at the full retard position or retard end stop position. To move towards the full retard position, the duty cycle is changed to greater than 40% but less than 60%, the force of the VFS 107 on the spool 111 is reduced and the spool 111 is moved to the left in an end stop lock mode in the figure by spring 115, until the force of spring 115 balances the force of the VFS 107. In the end stop lock mode shown, spool land 111*b* blocks line 113 and lines 112 and 114 are open. Camshaft torque pressurizes the advance chamber 102, causing fluid in the advance chamber 102 to move into the retard chamber 103, and the vane 104 to move towards the advance chamber wall 102*a*. Fluid exits from the advance chamber 102 through line 112 to the control valve 109 between spool lands 111*a* and 111*b* and recirculates back to central line 114 and line 113 leading to the retard chamber 103. The phaser is in a full retard position or retard end stop position when the vane 104 contacts the advance wall 102*a* or is substantially close the advance wall 102*a*.

Makeup oil is supplied to the phaser from supply S by pump 140 to make up for leakage and enters line 119. Line 119 splits into two lines 119*a* and 119*b*. Line 119*b* leads to an inlet check valve 118 and the control valve 109. From the control valve 109, fluid enters line 114 through the retard check valve 110 and flows to the retard chamber 103.

Line 119*a* leads to two different lines, line 146 to the end lock pin 147 and to line 145 to the intermediate lock pin 143. Line 145 further branches into line 132 which leads to the piloted valve 130. The pressure of the fluid in line 119*a* moves through the spool 111 between lands 111*c* and 111*d* into line 145 to bias the intermediate lock pin 143 against the spring 144 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked and the detent circuit is off. Line 146 also receives fluid from line 119*a*. The fluid in line 146 biases the end lock pin 147 into the recess 141 of an end plate 171 and is in a locked position, locking the housing assembly 100 relative to the rotor assembly 105. Exhaust line 121 is blocked by spool land 111*c* preventing lines 145 and 146 from venting.

The end lock pin 147 engages or is locked using pressure just before shutting down a hot engine. The spool valve 111 would stay in the 2 mm (end stop lock mode) position, trapping the oil behind the end lock pin 147 and holding the end lock pin 147 engaged for as long as the oil will remain in the lock pin chamber. If the engine goes to a customer initiated "key off" mode as opposed to an engine controlled shut down such as is used in "stop-start" engine technology then at "key off" the control valve 109 would move to the zero position, thereby venting and releasing the full stop lock. This would allow the phaser to return to the optimum cold start position during the next engine cranking cycle.

The holding position of the phaser preferably takes place between the retard and advance position of the vane relative to the housing. The stroke of the spool or position of the spool relative to the sleeve is 3.5 mm.

Figure 3:
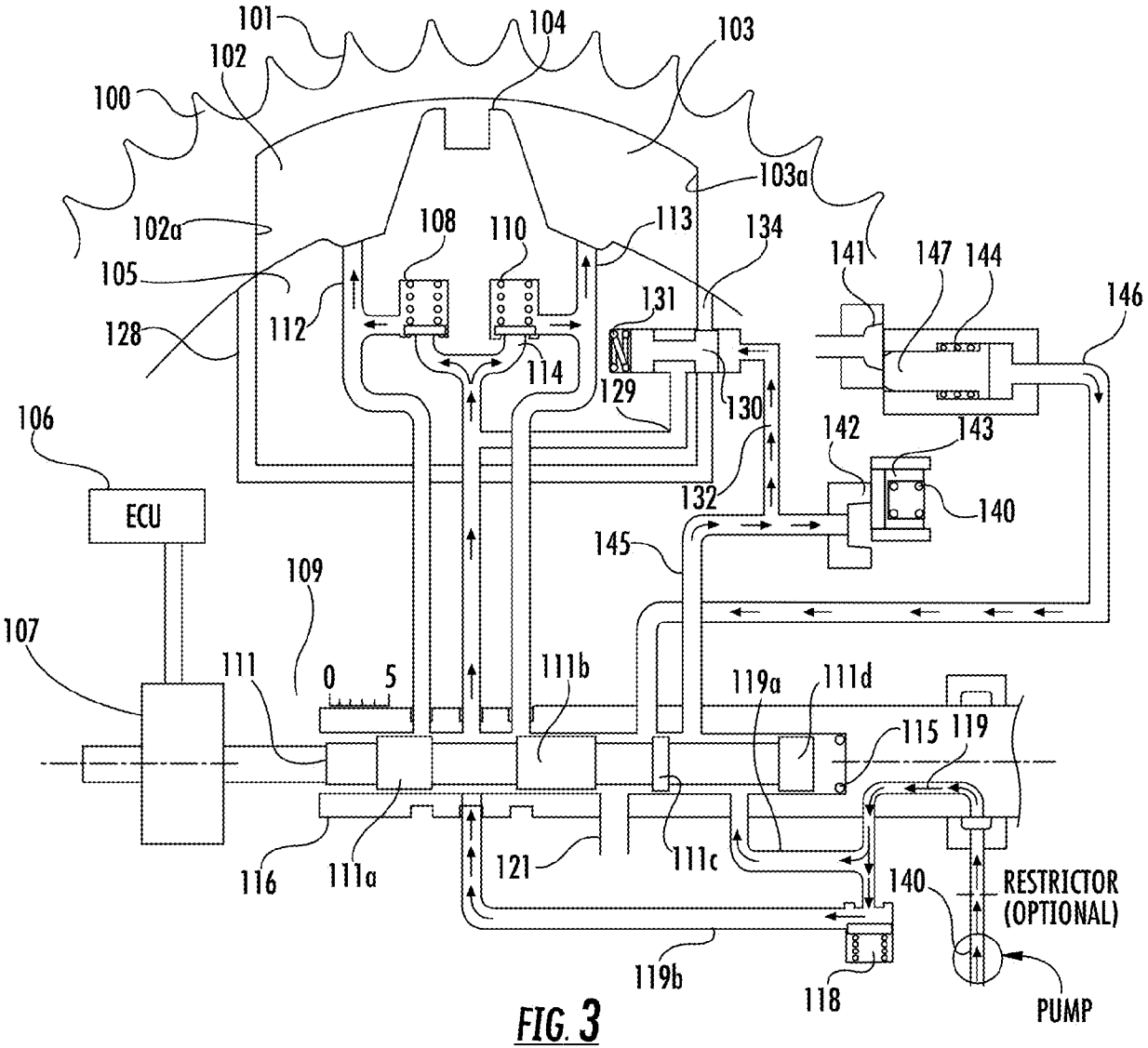
FIG. 3 shows a schematic of a cam torque actuated (CTA) phaser of a first embodiment in a holding position.

FIG. 3 shows the phaser in the null position. In this position, the duty cycle of the variable force solenoid 107 is approximately 60% and the force of the VFS 107 on one end of the spool 111 equals the force of the spring 115 on the opposite end of the spool 111 in holding mode. The lands 111*a* and 111*b* block the flow of fluid from lines 112 and 113 respectively. Makeup oil is supplied to the phaser from supply S by pump 140 to make up for leakage and enters line 119.

Line 119 splits into two lines 119*a* and 119*b*. Line 119*b* leads to inlet check valve 118 and the control valve 109. From the control valve 109, fluid enters line 114 through either of the check valves 108, 110 and flows to the advance or retard chambers 102, 103. Line 119*a* leads to line 145 and to the intermediate lock pin 143. Line 145 further branches into line 132 which leads to the piloted valve 130. The pressure of the fluid in line 119*a* moves through the spool 111 between lands 111*c* and 111*d* into lines 145 to bias the intermediate lock pin 143 against the intermediate lock pin spring 139 to a released position. The fluid in line 145 also flows through line 132 and pressurizes the piloted valve 130 against the spring 131, moving the piloted valve 130 to a position where retard detent line 134, advance detent line 128 and line 129 are blocked and the detent circuit is off. Exhaust line 121 is blocked by spool land 111*c* preventing line 145 from venting. Fluid in line 146 vents between spool lands 111*b* and 111*c* through exhaust line 121. The venting of line 146 allows the end lock pin spring 144 to bias the end lock pin 147 away from the recess to an unlocked position.

When the duty cycle is 0%, the vane of the phaser is in the mid-position or intermediate phase angle position. The stroke of the spool (position of the spool relative to the sleeve) is 0 mm.

FIG. 4 shows the phaser in the mid-position or intermediate phase angle position, where the duty cycle of the variable force solenoid is 0%, the spool 109 is in detent mode, the piloted valve 130 is vented through the spool to exhaust line 121 leading to sump or exhaust, and the hydraulic detent circuit 133 is open or on.

Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0% the rotor assembly 105 would move via the detent circuit to the mid-position or intermediate phase angle position and the intermediate lock pin 143 would be engaged in mid-position or intermediate phase angle position regardless of what position the vane 104 was in relative to the housing assembly 100 prior to the abnormal shut down of the engine.

The ability of the phaser of the present invention to default to a mid-position or intermediate phase angle position without using electronic controls allows the phaser to move to the mid-position or intermediate phase angle position even during engine cranking when electronic controls are not typically used for controlling the cam phaser position. In addition, since the phaser defaults to the mid-position or intermediate phase angle position, it provides a fail-safe position, especially if control signals or power or lost, that guarantees that the engine will be able to start and run even without active control over the VCT phaser. Since the phaser has the mid-position or intermediate phase angle position upon cranking of the engine, longer travel of the phase of the phaser is possible, providing calibration opportunities. In the prior art, longer travel phasers or a longer phase angle is not possible, since the mid-position or intermediate phase angle position is not present upon engine cranking and startup and the engine has difficulty starting at either the extreme advance or retard stops.

When the duty cycle of the variable force solenoid 107 is just set to 0%, the force on the VFS on the spool 111 is decreased, and the spring 115 moves the spool 111 to the far left end of the spool's travel to a detent mode. In the detent mode, spool land 111*b* blocks the flow of fluid from line 112 in between spool lands 111*a* and 111*b* from entering any of the other lines and line 113, effectively removing control of the phaser from the control valve 109. At the same time, fluid from supply may flow through line 119 to line 119*b* and inlet check valve 118 to the common line 114 around the bore within the sleeve 116.

Fluid is prevented from flowing from line 119*a* to line 145 and line 132 to the piloted valve 130 by spool land 111*d*. Since fluid cannot flow to lines 145 and 132, the piloted valve 130 vents to exhaust line 121, opening passage between the advance detent line 128 and the retard detent line 134 through the piloted valve 130 to line 129 and the common line 114, in other words, opening or turning on the hydraulic detent circuit 133. With exhaustion of fluid from lines 132 and 145, the intermediate lock pin spring 139 biases the intermediate lock pin 143 to engage the recess 142 in an end plate of the housing assembly 100 and lock the housing assembly 100 relative to the rotor assembly 105. At the same time, fluid is also exhausted from line 146 through exhaust line 121. With fluid exhausting from line 146, the end lock pin spring 147 biases the end lock pin 147 to a released, unlocked position.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to a mid-position or intermediate phase angle position within the chamber formed between the housing assembly 100 and the rotor assembly 105.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor assembly 105 closes off line the retard detent 134 from the retard chamber 103, the vane 104 is moved to a mid-position or intermediate phase angle position within the chamber formed between the housing assembly 100 and the rotor assembly 105.

Figure 8:
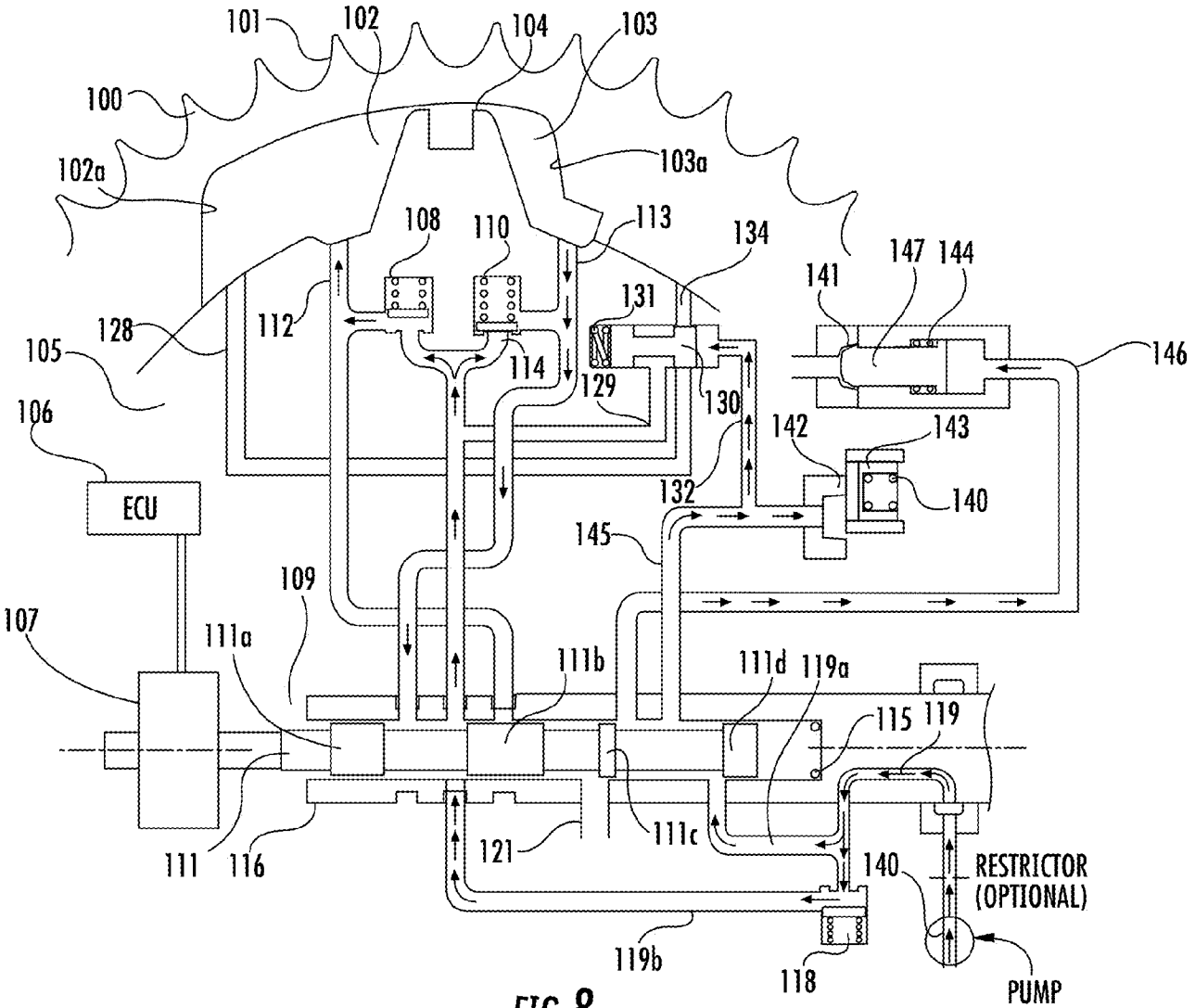
FIG. 8 shows a schematic of a cam torque actuated (CTA) phaser of an alternate embodiment in a full stop advance position with an end lock pin in a locked position, locking the phaser.

It should be noted that while the end stop lock mode was described as locking the phaser in a full retard position, the full retard position may be replaced with a locking of the phaser in a full advance position. In this position, full advance position is when the vane 104 contacts the retard wall 103*a* or is substantially close to the retard wall 103*a* as shown in FIG. 8 and may be referred to as an "advance end stop position" of the vane.

For a phaser with the end stop lock mode in a full advance position, in the advance mode, the spool 111 is moved to a position so that fluid may flow from the retard chamber 103 through the spool 111 to the advance chamber 102, fluid is blocked from exiting the advance chamber 102, and the detent valve circuit 133 is off or closed. Both of the lock pins 147, 143 are in an unlocked position.

In the retard mode, the spool 111 is moved to a position so that fluid may flow from the advance chamber 102 through the spool 111 to the retard chamber 103, fluid is blocked from exiting the retard chamber 103, and the detent valve circuit 133 is off and both of the lock pins 147, 143 are in an unlocked position.

In null mode, the spool 111 is moved to a position that blocks the exit of fluid from the advance and retard chambers 102, 103, and the detent valve circuit 133 is off.

In the advance locking mode, the vane 104 has already been moved to a full advance position and flow from the retard chamber 103 through the spool 111 to the advance chamber 102 continues with fluid blocked from exiting the advance chamber 102. In this mode, the detent circuit is off, and the end lock pin 147 is pressurized, thus causing the spring 144 to compress and allow the end lock pin 147 to engage the recess 141 of an end plate and move to a locked position. The "full advance position" is defined as when the vane 104 contacts the retard wall 103*a* of the chamber 117 or is substantially close to the retard wall 103*a* and may be referred to as an "advance end stop position" of the vane.

In the detent mode, three functions occur. The first function in the detent mode is that the spool 111 moves to a position in which spool land 111*b* blocks the flow of fluid from line 112 in between spool lands 111*a* and 111*b* from entering any of the other lines and line 113, effectively removing control of the phaser from the control valve 109. The second function in detent mode is to open or turn on the detent valve circuit 133. The detent valve circuit 133 has complete control over the phaser moving to advance or retard, until the vane 104 reaches the intermediate phase angle position. The third function in the detent mode is to vent the lock pin circuit 123, allowing the intermediate lock pin 143 to engage the recess 142 in an end plate of the housing assembly 100. It should be noted that the end lock pin 147 is also vented and is spring biased by the end lock pin spring 144 to an unlocked position. The intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 111 moves to a corresponding position along its stroke. When the duty cycle of the variable force solenoid 107 is approximately 40%, 60%, and greater than 60%, the spool 111 will be moved to positions that correspond with the advance mode/advance locking mode, the null mode, and the retard mode, respectively and the piloted valve 130 will be pressurized and moves to and remains in a first position, the hydraulic detent circuit 133 will be closed, and the intermediate lock pin 143 will be pressurized and released to an unlocked position. In the retard locking mode or end stop lock mode, the end lock pin 147 is pressurized and engages the recess 141 of an end plate of the housing assembly 100.

When the duty cycle of the variable force solenoid 107 is 0%, the spool 111 is moved to the detent mode such that the piloted valve 130 vents and moves to a second position, the hydraulic detent circuit 133 will be open, and the intermediate lock pin 143 vented and engaged with the recess 142. The end lock pin 147 is also vented through line 146 to exhaust line 121, such that the end lock pin spring 144 biases the end lock pin 147 out of engagement with the recess 141 and is therefore in an unlocked position. A duty cycle of 0% was chosen as the extreme position along the spool stroke to open the hydraulic detent circuit 133, vent the piloted valve 130, and vent and engage the intermediate lock pin 143 with the recess 142, since if power or control is lost, the phaser will default to a locked position. It should be noted that the duty cycle percentages listed above are an example and they may be altered. Furthermore, the hydraulic detent circuit 133 may be open, the piloted valve 130 vented, and the intermediate lock pin 143 vented and engaged with the recess 142 at 100% duty cycle, if desired.

When the duty cycle is set to be greater than 60%, the vane of the phaser is moving toward and/or in a retard position. The stroke of the spool or position of the spool relative to the sleeve is between 3.5 and 5 mm for the retard position.

When the duty cycle is set between 40-60%, the vane of the phaser is moving toward and/or in an advance position. The stroke of the spool or position of the spool relative to the sleeve is between 2 and 3.5 mm for the advance position.

The holding position of the phaser preferably takes place between the retard and advance position of the vane relative to the housing. The stroke of the spool or position of the spool relative to the sleeve is 3.5 mm.

When the duty cycle is 0%, the vane of the phaser is in the mid-position or intermediate phase angle position. The stroke of the spool (position of the spool relative to the sleeve) is 0 mm.

Figure 6:
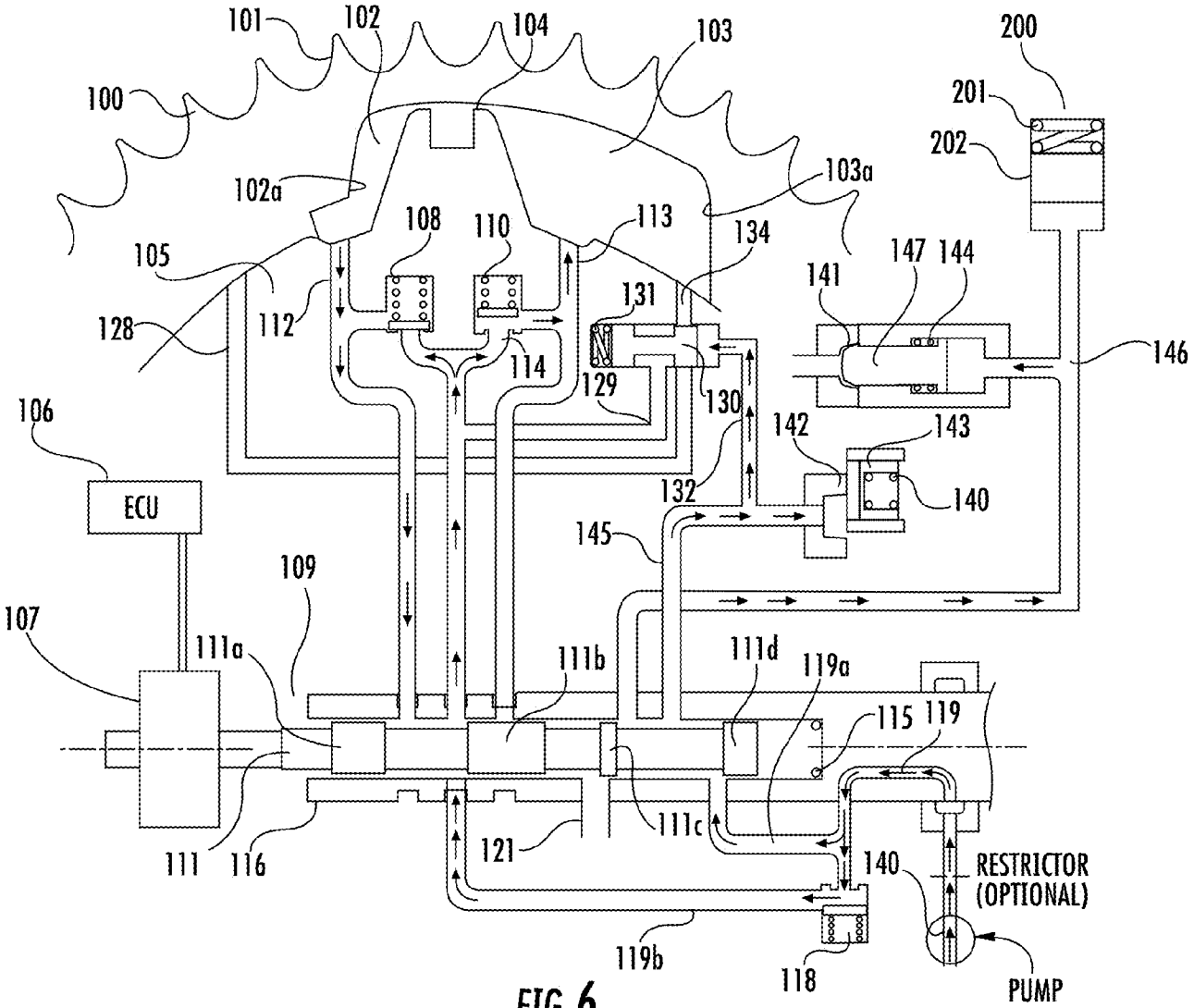
FIG. 6 shows a schematic of a cam torque actuated (CTA) phaser of a second embodiment with an accumulator in fluid communication with an retard end lock pin and the retard end lock pin in a locked position, locking the phaser.

FIG. 6 shows a phaser of a second embodiment in the retard locking position at the full retard position or retard end stop position. This phaser is similar to the phaser of FIG. 2, with an accumulator 200 added to line 146. Since it is anticipated that the oil behind the end lock pin 147 may leak out sooner than desired allowing the end lock pin 147 to disengage before the hot engine is restarted, an accumulator 200 may be in fluid communication with line 146 of the lock pin switching circuit 123. The accumulator 200 increases the time in which the end lock pin 147 is engaged with the recess 141 after engine shut down. The accumulator 200 is a pressure storage reservoir in which a non-compressible hydraulic fluid is held under pressure by an external source 201, 202. In this embodiment, the external source is a spring 201 biased piston 202. The external source can also be a spring, a raised weight, or a compressed gas. The other positions, for example the null mode (holding position), the advance mode, the retard mode and the detent mode are as discussed above relative to FIGS. 1, 3, 4 and 5 and are incorporated here by reference.

It should be noted that in FIG. 6, the accumulator 200 could also communicate with lines 119 and 119*a* and produce similar results as when the accumulator is placed in line 146.

Figure 7:
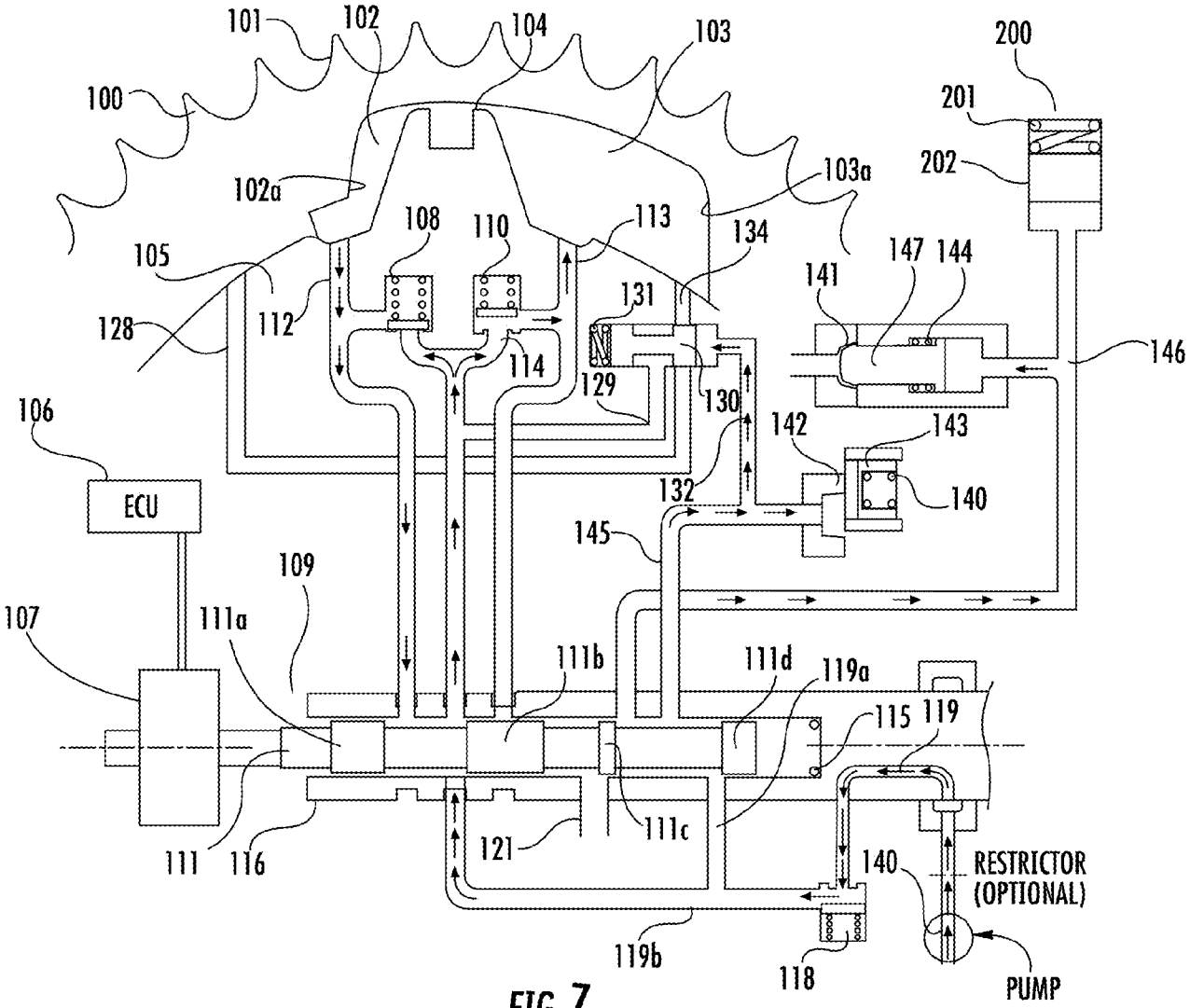
FIG. 7 shows a schematic of a cam torque actuated (CTA) phaser of a third embodiment with the source oil and pressure to the intermediate lock pin downstream of the inlet check valve.

FIG. 7 shows a phaser of a third embodiment in the retard locking position at the full retard position or retard end stop position. This phaser is similar to the phaser of FIG. 6, with an accumulator 200 added to line 146. The difference between this phaser and the phaser of FIG. 6 is the placement of the inlet check valve 118. In the phaser of FIG. 7, fluid is supplied to the intermediate lock pin 143 and the end lock pin 147 from a source S and flows through the inlet check valve 118 as opposed to prior to the inlet check valve 118 as shown in FIGS. 1-5.

It should be noted that in FIG. 6, the accumulator 200 could also communicate with lines 119, 119*a* or 119*b* and produce similar results as when the accumulator is placed in line 146.

It should be noted that while the end stop lock mode in FIGS. 6-7 were described as locking the phaser in a full retard position, the full retard position may be replaced with a locking of the phaser in a full advance position. In this position, full advance position is when the vane 104 contacts the retard wall 103*a* or is substantially close to the retard wall 103*a* as shown in FIG. 8 and may be referred to as an "advance end stop position" of the vane.

FIGS. 9-15 show the operating modes of TA VCT phaser depending on the spool valve position. The positions shown in the figures define the direction the VCT phaser is moving to. It is understood that the phaser control valve has an infinite number of intermediate positions, so that the control valve not only controls the direction the VCT phaser moves, but depending on the discrete spool position, controls the rate at which the VCT phaser changes positions. Therefore, it is understood that the phaser control valve can also operate in infinite intermediate positions and is not limited to the positions shown in Figures.

Oil pressure from an oil supply 140 moves the vane 104. The control valve 209 allows the vane 104 in the phaser to move by permitting fluid flow from the supply 140 to the advance chamber 102 and from the retard chamber 103 to an exhaust line 122 or from supply 140 to the retard chamber 103 and from the advance chamber 102 to an exhaust line 121, depending on the desired direction of movement.

The housing assembly 100 of the phaser has an outer circumference 101 for accepting drive force, an inner end plate (not shown) and an outer end plate (not shown). The rotor assembly 105 is connected to the camshaft and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105.

Additionally, a hydraulic detent circuit 233 (not shown) and a lock pin circuit 123 (not shown) are also present. The hydraulic detent circuit 233 and the lock pin circuit 123 are essentially one circuit as discussed above, but will be discussed separately for simplicity.

The hydraulic detent circuit 233 includes a spring 131 loaded piloted valve 130 and an advance detent line 128 that connects the advance chamber 102 to the piloted valve 130 and the common line 214, a retard detent line 134 that connects the retard chamber 103 to the piloted valve 130, and a line 129 connected to the piloted valve 130 and the common line 214. It should be noted that in this phaser, the common line 214 is only connected to the piloted valve 130 and does not connect directly to control valve 209. The common line 214 is further in fluid communication with an advance check valve 108 and a retard check valve 110. The advance and retard check valves 108, 110 prevent fluid from the advance and retard chambers 102, 103 from entering line 129 and the hydraulic detent circuit 233.

The advance and retard check valves 108, 110 always prevent oil from entering line 129 whether the piloted valve 130 is open or closed. The piloted valve 130 prevents forward flow from advance detent line 128 and retard detent line 134 when closed. The check valves 108, 110 prevent back flow at all times.

The advance detent line 128 and the retard detent line 134 are a predetermined distance or length from the vane 104. The piloted valve 130 is in the rotor assembly 105 and is fluidly connected to the lock pin circuit 123 and line 119*a* through line 132. The lock pin circuit 123 includes an intermediate lock pin 143, an intermediate lock pin spring 139, line 132, the piloted valve 130, supply line 119*a*, line 145, exhaust line 121, line 146, the end lock pin 147, and the end lock pin spring 144.

The intermediate lock pin 143 and the end lock pin 147 are slidably housed in bores in the rotor assembly 105 and more preferably in the vane 104. An end portion of the intermediate lock pin 143 is spring biased towards and fits into a recess 142 in an end plate of the housing assembly 100 by an intermediate lock pin spring 139. An end portion of the end lock pin 147 is biased away from the recess 141 and hydraulically biased towards and fits into a recess 141 in an end plate of the housing assembly 100. The opening and closing of the hydraulic detent circuit 233 and pressurization of the lock pin circuit 123 are both controlled by the switching/movement of the phase control valve 209.

Figure 9:
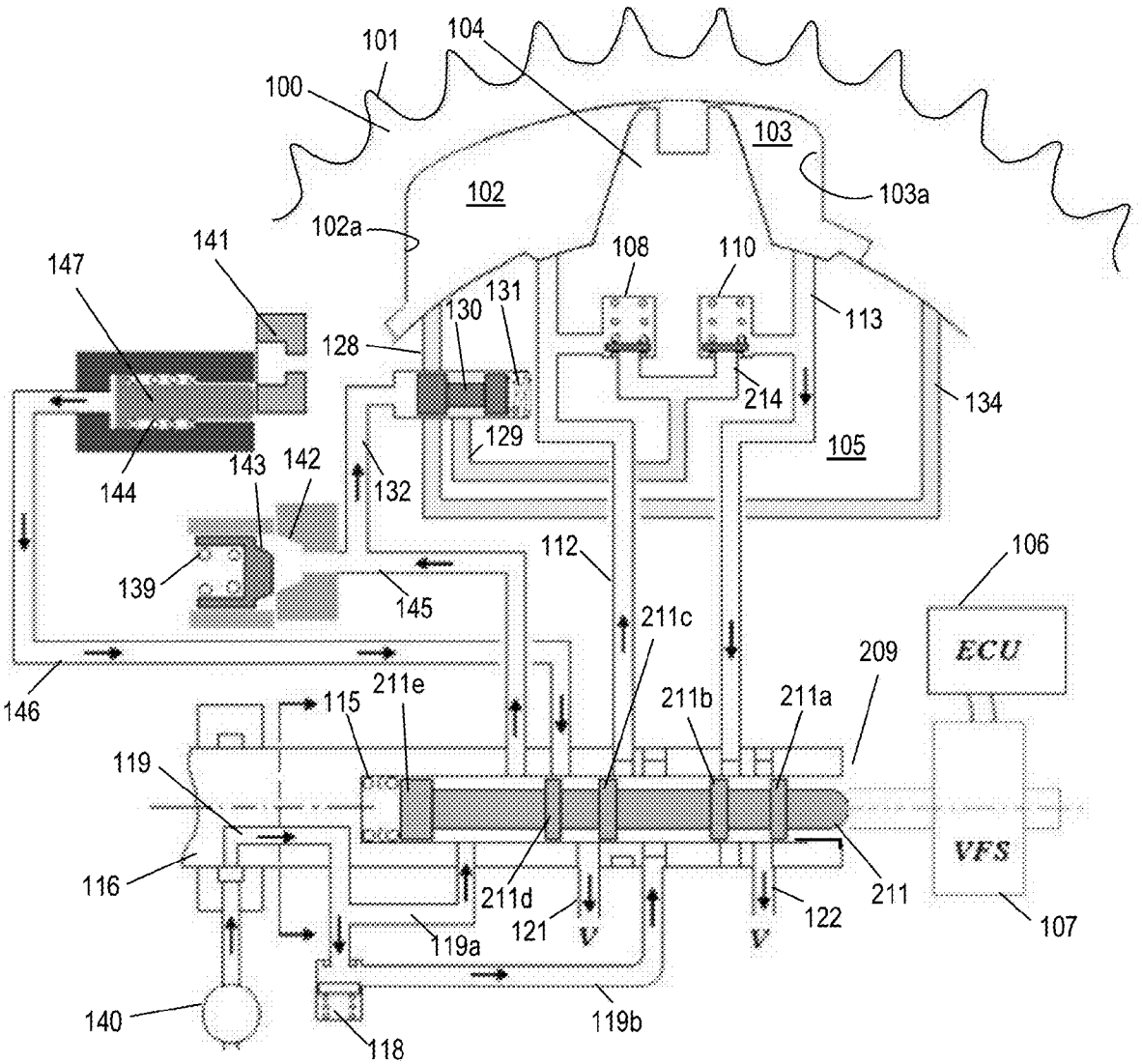
FIG. 9 shows a schematic of a torsion assist (TA) phaser of another alternate embodiment moving towards a full advance position.
Figure 11:
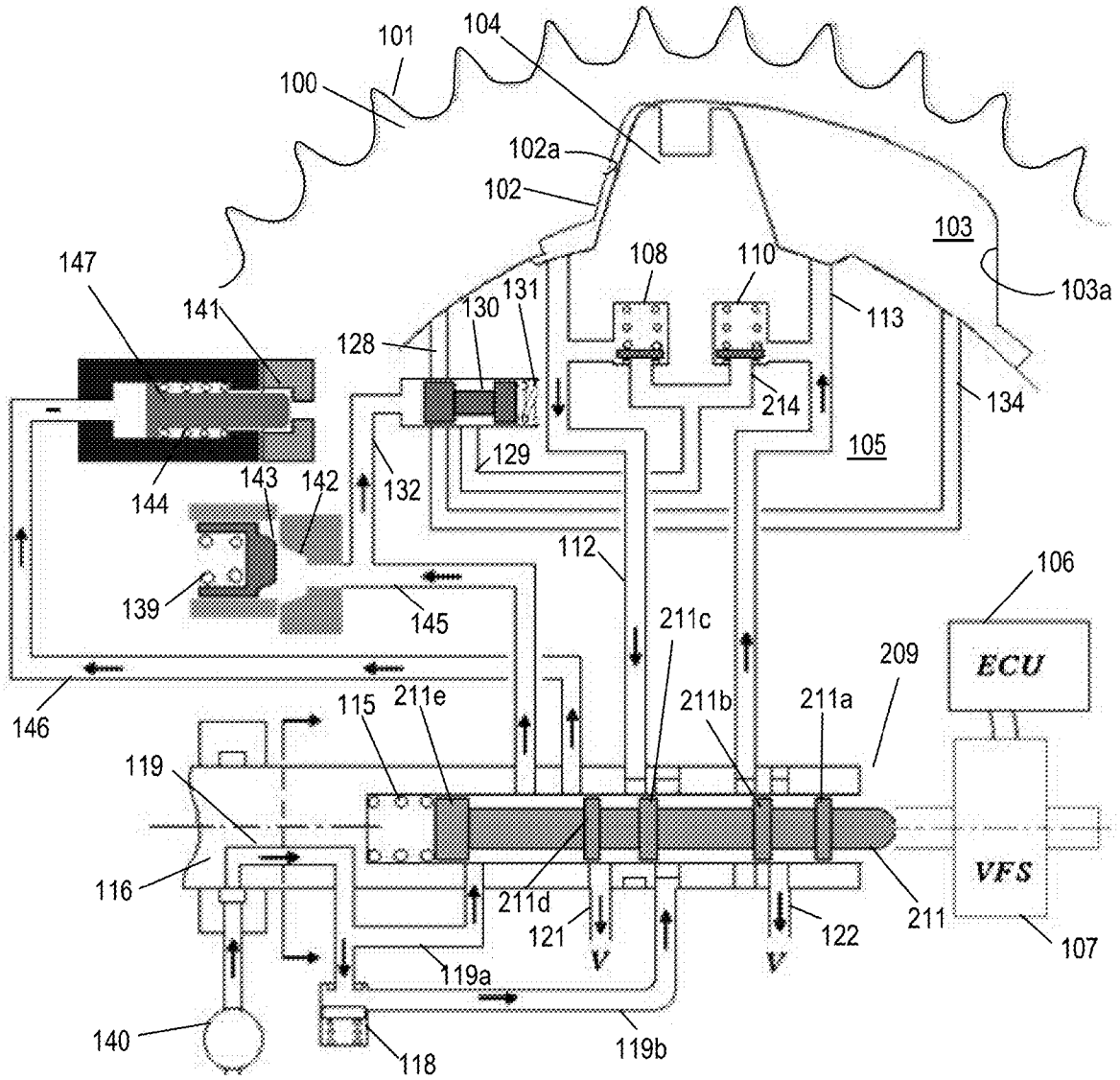
FIG. 11 shows a schematic of a torsion assist (TA) phaser of another alternate embodiment in a full stop retard position with an end lock pin in a locked position, locking the phaser.
Figure 13:
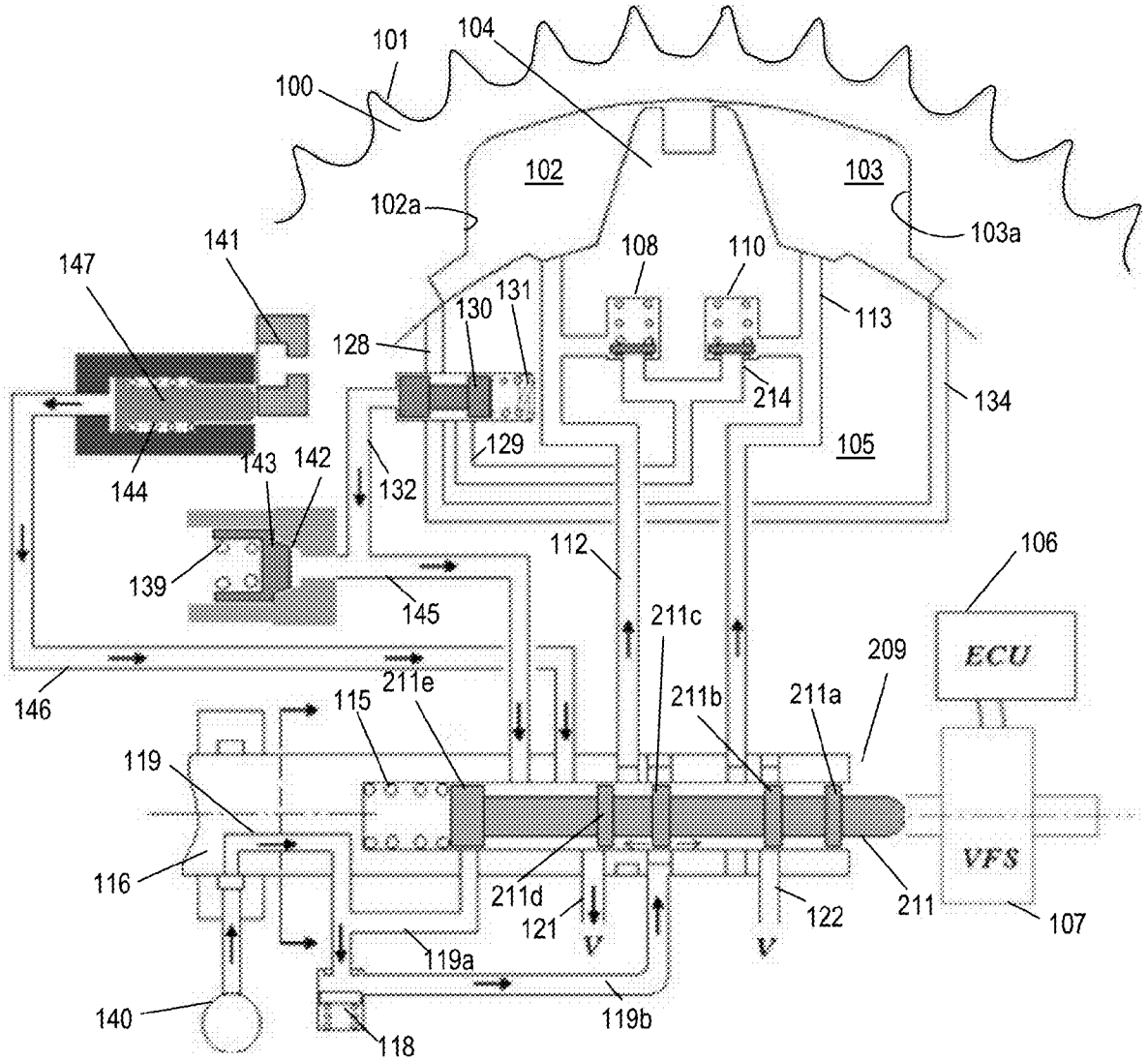
FIG. 13 shows a schematic of a torsion assist (TA) phaser of another alternate embodiment with a hydraulic circuit in an open position and the intermediate lock pin in a locked position, locking the phaser.

While the intermediate lock pin 143 and the end lock pin 147 are part of the overall lock pin circuit 123, there are independent modes in which the end lock pin 147 is vented, while the intermediate lock pin is pressurized or filled. For example, when the spool is full in, or moving towards the advance position as shown in FIG. 9, the intermediate lock pin 143 is pressurized or filled, moving the intermediate lock pin 143 to an unlocked position and the end lock pin 147 is vented or not filled, moving the end lock pin to an unlocked position. During low duty cycle, the intermediate lock pin 143 is pressurized or filled, moving the intermediate lock pin 143 to an unlocked position and the end lock pin 147 is also pressurized or filled, moving the end lock pin 147 to a locked position as shown in FIG. 11. During 0% duty cycle, the intermediate lock pin 143 and the end lock pin 147 are both vented or not filled, such that the intermediate lock pin 143 is moved to a locked position and the end lock pin 147 is moved to an unlocked position as shown in FIG. 13.

A control valve 209, preferably a spool valve, includes a spool 211 with cylindrical lands 211*a*, 211*b*, 211*c*, 211*d*, 211*e* slidably received in a sleeve 116. The control valve may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 211 may contact and be influenced by a motor, or other actuators in place of the variable force solenoid 107.

The position of the control valve 209 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 211 is influenced by spring 115 and the solenoid 107 controlled by the ECU 106. Further detail regarding control of the phaser is discussed in detail below. The position of the spool 211 controls the motion (e.g. to move towards the advance position, holding position, the retard position or the retard lock position) of the phaser as well as whether the lock pin circuit 123 and the hydraulic detent circuit 233 are open (on) or closed (off) and whether the intermediate lock pin 143 or end lock pin 147 is in a locked or unlocked position. In other words, the position of the spool 211 actively controls the piloted valve 130. The control valve 209 has an advance mode, a retard mode, a retard lock mode, a null mode (holding position), and a detent mode.

In the advance mode, the spool 211 is moved to a position so that fluid may flow from the supply 140, through the spool 211 and into the advance chamber 102. Fluid is blocked from exiting the advance chamber 102 by the spool 211. Fluid in the retard chamber 103 vents through the spool 211 to an exhaust line 122. The detent valve circuit 133 is off or closed. Both of the lock pins 147, 143 are in an unlocked position.

In the retard mode, the spool 211 is moved to a position so that fluid may flow from the supply 140, through the spool 211 to the retard chamber 103. Fluid is blocked from exiting the retard chamber 103 by the spool 211. Fluid in the advance chamber 102 vents through the spool 211 to an exhaust line 121. The detent valve circuit 233 is off and both of the lock pins 147, 143 are in an unlocked position.

In null mode, the spool 211 is moved to a position that blocks the exit of fluid from the advance and retard chambers 102, 103, and the detent valve circuit 233 is off In the retard locking mode or end stop lock mode, the vane 104 has already been moved to a full retard position or retard end stop position and fluid from the advance chamber 102 flows through the spool 211 to exhaust line 121. Fluid is still provided to the retard chamber from the supply 140. In this mode, the detent circuit is off, and the end lock pin 147 is pressurized, thus causing the spring 144 to compress and allow the end lock pin 147 to engage the recess 141 of an end plate and move to a locked position. The "full retard position" is defined as when the vane 104 contacts the advance wall 102*a* of the chamber 117 or is substantially close to the advance wall 102*a* and may be referred to as a "retard end stop position" of the vane.

In the detent mode, three functions occur. The first function in the detent mode is that the spool 211 moves to a position in which spool land 211*b* blocks the flow of fluid from line 113 and the retard chamber 103 from exiting to the exhaust line 122, and spool land 211*d* blocks the flow of fluid from line 112 and the advance chamber 102 from exiting to the exhaust line 121, effectively removing control of the phaser from the control valve 209. The second function in detent mode is to open or turn on the detent valve circuit 233. The detent valve circuit 233 has complete control over the phaser moving to advance or retard, until the vane 104 reaches the intermediate phase angle position. The third function in the detent mode is to vent the lock pin circuit 123, allowing the intermediate lock pin 143 to engage the recess 142 in an end plate of the housing assembly 100. It should be noted that the end lock pin 147 is also vented and is spring biased by the end lock pin spring 144 to an unlocked position. The intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 211 moves to a corresponding position along its stroke. When the duty cycle of the variable force solenoid 107 is approximately 40%, 60%, and greater than 60%, the spool 211 will be moved to positions that correspond with the retard mode/retard locking mode, the null mode, and the advance mode, respectively and the piloted valve 130 will be pressurized and moves to and remains in a first position, the hydraulic detent circuit 233 will be closed, and the intermediate lock pin 143 will be pressurized and released to an unlocked position. In the retard locking mode or end stop lock mode, the end lock pin 147 is pressurized and engages the recess 141 of an end plate of the housing assembly 100.

When the duty cycle of the variable force solenoid 107 is 0%, the spool 211 is moved to the detent mode such that the piloted valve 130 vents and moves to a second position, the hydraulic detent circuit 233 will be open, and the intermediate lock pin 143 vented and engaged with the recess 142. The end lock pin 147 is also vented through line 146 to exhaust line 121, such that the end lock pin spring 144 biases the end lock pin 147 out of engagement with the recess 141 and is therefore in an unlocked position. A duty cycle of 0% was chosen as the extreme position along the spool stroke to open the hydraulic detent circuit 133, vent the piloted valve 130, and vent and engage the intermediate lock pin 143 with the recess 142, since if power or control is lost, the phaser will default to a locked position. It should be noted that the duty cycle percentages listed above are an example and they may be altered. Furthermore, the hydraulic detent circuit 233 may be open, the piloted valve 130 vented, and the intermediate lock pin 143 vented and engaged with the recess 142 at 100% duty cycle, if desired.

When the duty cycle is set to be greater than 60%, the vane of the phaser is moving toward and/or in an advance position. The stroke of the spool or position of the spool relative to the sleeve is between 3.5 and 5 mm for the advance position.

FIG. 9 shows the phaser moving towards the advance position. To move towards the advance position, the duty cycle is increased to greater than 60%, the force of the VFS 107 on the spool 211 is increased and the spool 211 is moved to the left by the VFS 107 in an advance mode, until the force of the spring 115 balances the force of the VFS 107.

In the advance mode, spool land 211 c prevents fluid from the advance chamber 102 and from supply from exhausting into exhaust line 121. Fluid is supplied to the phaser from supply S by pump 140 and enters line 119. If the control valve 209 is in the camshaft, line 119 may be drilled through a bearing. Line 119 splits into two lines 119*a* and 119*b*. Line 119*b* leads to an inlet check valve 118 and the control valve 209. From line 119*b* fluid is supplied through the spool 211 between spool lands 211*b* and 211*c* to the advance chamber 102 through line 112. At the same time, fluid in the retard chamber 103 is exhausted through line 113, through the spool 211 between spool lands 211*a* and 211*b* to the exhaust line 122. Fluid is prevented from being supplied from supply 140 to the retard chamber 103 by spool land 211*b*. The fluid in the advance chamber 102 moves the vane 104 towards the retard wall 103*a*.

Line 119*a* leads to two different lines, line 146 to the end lock pin 147 and line 145 to the intermediate lock pin 143. Line 145 further branches into line 132 which leads to the piloted valve 130. The pressure of the fluid in line 119*a* moves through the spool 211 between lands 211*d* and 211*e* into line 145 to bias the intermediate lock pin 143 against the intermediate lock pin spring 139 to a released position. The fluid in line 145 also flows through line 132 and pressurizes the piloted valve 130 against the spring 131, moving the piloted valve 130 to a position where retard detent line 134, advance detent line 128 and line 129 are blocked as shown in FIG. 9 and the detent circuit is off. At the same time, fluid from line 146 is in fluid communication with the end lock pin 147 and is vented to exhaust line 121 between spool lands 211*d* and 211*c*, such that the end lock pin spring 144 biases the end lock pin 147 out of engagement with the recess 141 and is therefore in an unlocked position. Exhaust line 121 is blocked by spool land 211*d* preventing line 145 from venting.

When the duty cycle is set between 40-60%, the vane of the phaser is moving toward and/or in a retard position. The stroke of the spool or position of the spool relative to the sleeve is between 2 and 3.5 mm for the retard position.

Figure 10:
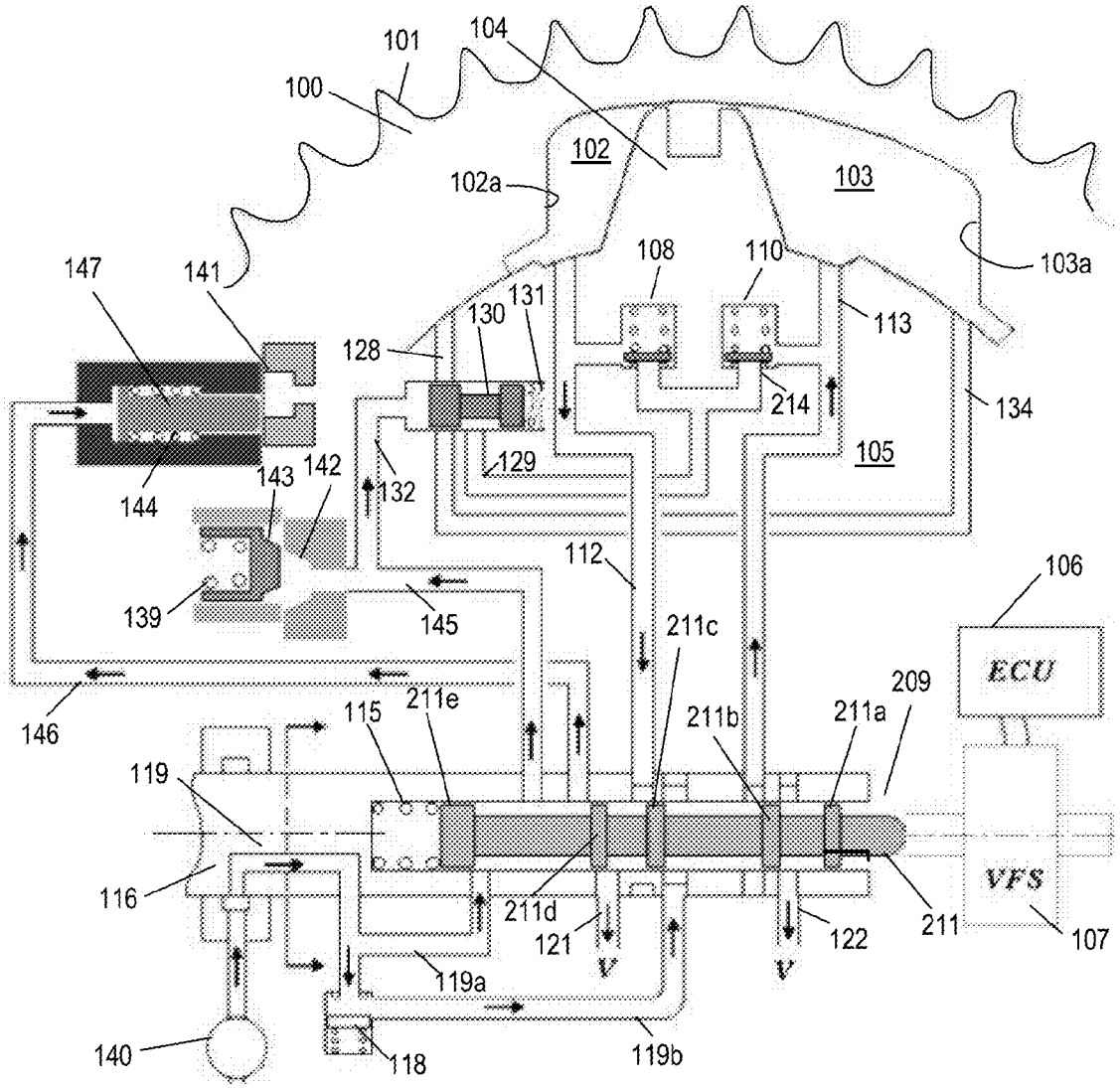
FIG. 10 shows a schematic of a torsion assist (TA) phaser of another alternate embodiment moving towards a retard position.

FIG. 10 shows the phaser moving towards the retard position. To move towards the retard position, the duty cycle is changed to greater than 40% but less than 60%, the force of the VFS 107 on the spool 211 is reduced and the spool 211 is moved by spring 115, until the force of spring 115 balances the force of the VFS 107.

In the retard mode, spool land 211*b* prevents fluid from the retard chamber 103 and from supply S from exhausting into exhaust line 122. Fluid is supplied to the phaser from supply S by pump 140 and enters line 119. If the control valve 209 is in the camshaft, line 119 may be drilled through a bearing. Line 119 splits into two lines 119*a* and 119*b*. Line 119*b* leads to an inlet check valve 118 and the control valve 209. From line 119*b* fluid is supplied through the spool 211 between spool lands 211*b* and 211*c* to the retard chamber 103 through line 113. At the same time, fluid in the advance chamber 102 is exhausted through line 112, through the spool 211 between spool lands 211*c* and 211*d* to the exhaust line 121. Fluid is prevented from being supplied from supply 140 to the advance chamber 102 by spool land 211*c*. The fluid in the retard chamber 103 moves the vane 104 towards the advance wall 102*a*.

Line 119*a* leads to two different lines, line 146 to the end lock pin 147 and line 145 to the intermediate lock pin 143. Line 145 further branches into line 132 which leads to the piloted valve 130. The pressure of the fluid in line 119*a* moves through the spool 211 between lands 211*d* and 211*e* into line 145 to bias the intermediate lock pin 143 against the intermediate lock pin spring 139 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked and the detent circuit is off. Line 146 is pressurized with fluid from line 119*a* and the end lock pin 147 will remain partially biased against the spring 144 in a released position until the recess 141 of the end plate aligns with the end lock pin 147 as shown in FIG. 10. Exhaust line 121 is blocked by spool land 211*d* preventing lines 145 and 146 from venting.

When the duty cycle is set between 40-60%, the vane of the phaser is moving toward and/or in a retard locking position. The stroke of the spool or position of the spool relative to the sleeve is approximately 2 mm for the retard locking position.

FIG. 11 shows the phaser in the retard locking position at the full retard position or retard end stop position. To move towards the full retard position, the duty cycle is changed to greater than 40% but less than 60%, the force of the VFS 107 on the spool 211 is reduced and the spool 211 is moved to the right in an end stop lock mode in the figure by spring 115, until the force of spring 115 balances the force of the VFS 107.

In the end stop lock mode shown, spool land 211*b* prevents fluid from the retard chamber 103 and from supply S from exhausting into exhaust line 122. Fluid is supplied to the phaser from supply S by pump 140 and enters line 119. If the control valve 209 is in the camshaft, line 119 may be drilled through a bearing. Line 119 splits into two lines 119*a* and 119*b*. Line 119*b* leads to an inlet check valve 118 and the control valve 209. From line 119*b* fluid is supplied through the spool 211 between spool lands 211*b* and 211*c* to the retard chamber 103 through line 113. At the same time, fluid in the advance chamber 102 is exhausted through line 112, through the spool 211 between spool lands 211 c and 211 d to the exhaust line 121. Fluid is prevented from being supplied from supply 140 to the advance chamber 102 by spool land 211*c*. The fluid in the retard chamber 103 moves the vane 104 towards the advance wall 102*a*. It should be noted that the end stop lock mode is similar to the retard mode shown in FIG. 10, except that the vane 104 has been moved into approximate contact with the advance wall 103*a*, allowing the end lock pin 147 to align and engage in recess 141 of the end plate of the housing assembly 100. The engagement of the end lock pin 147 with the recess 141 of the end plate of the housing assembly 100, locks the vane 104 relative to the rotor assembly 105 in a position with the vane 104 at an extreme end of travel. The intermediate lock pin 143 remains in a released position. Exhaust line 121 is blocked by spool land 211*d* preventing lines 145 and 146 from venting.

The fluid in line 145 also flows through line 132 and pressurizes the piloted valve 130 against the spring 131, moving the piloted valve 130 to a position where retard detent line 134, advance detent line 128 and line 129 are blocked and the detent circuit is off.

The end lock pin 147 engages or is locked using pressure just before shutting down a hot engine. The spool valve 211 would stay in the 2 mm (end stop lock mode) position, trapping the oil behind the end lock pin 147 and holding the end lock pin 147 engaged for as long as the oil will remain in the lock pin chamber. If the engine goes to customer initiated "key off" mode as opposed to an engine controlled shut down such as is used in "stop-start" engine technology then at "key off" the control valve 209 would move to the zero position thereby venting and releasing the full stop lock. This would allow the phaser to return to the optimum cold start position during the next engine cranking cycle.

Figure 12:
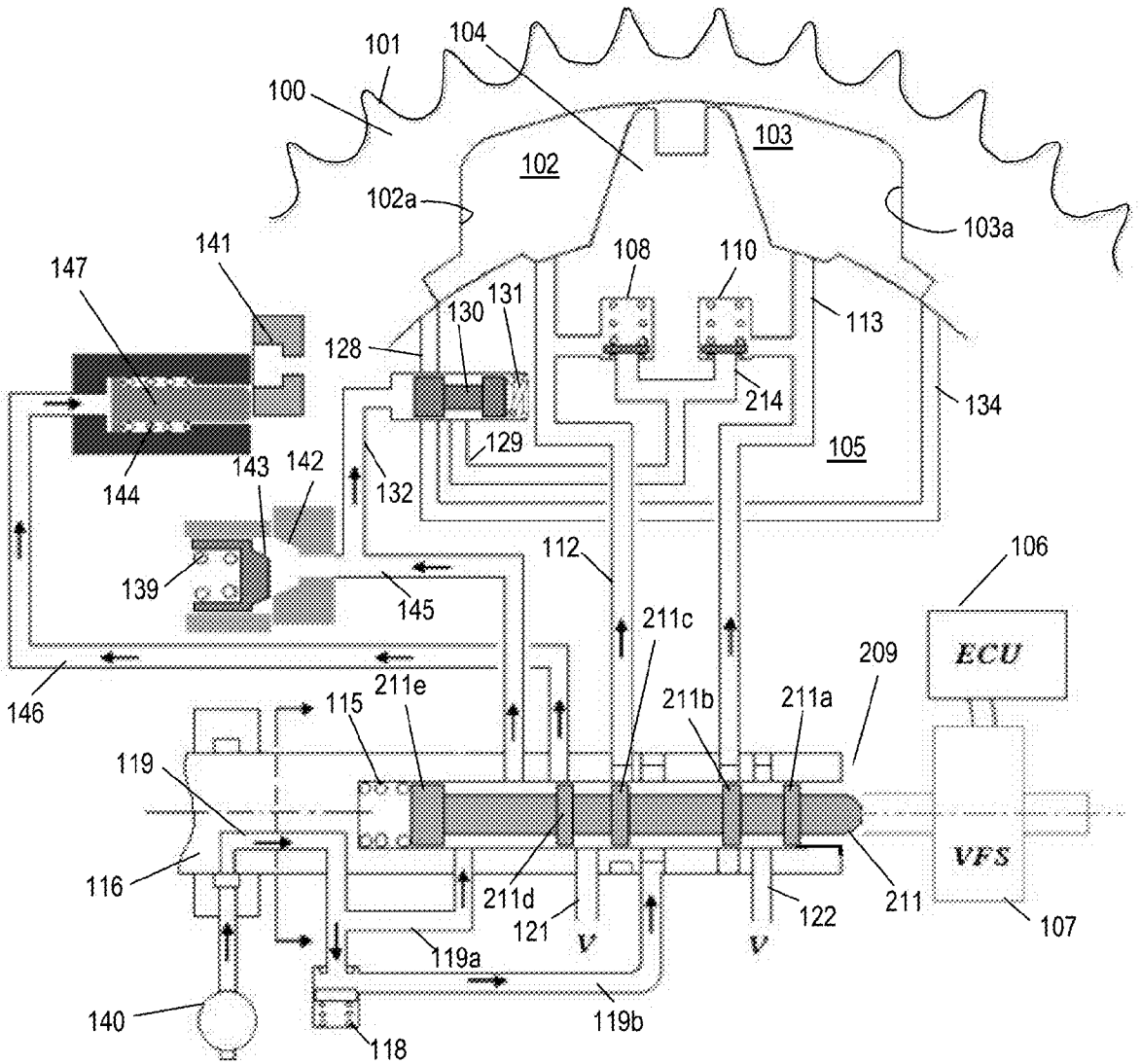
FIG. 12 shows a schematic of a torsion assist (TA) phaser of another alternate embodiment in a holding position.

The holding position of the phaser preferably takes place between the retard and advance position of the vane relative to the housing. The stroke of the spool or position of the spool relative to the sleeve is 3.5 mm. FIG. 12 shows the phaser in the null position. In this position, the duty cycle of the variable force solenoid 107 is approximately 60% and the force of the VFS 107 on one end of the spool 211 equals the force of the spring 115 on the opposite end of the spool 211 in holding mode. The lands 211*b* and 211*c* allow a small amount of fluid to flow from supply S, through line 119 and the inlet check valve 118, to line 119*b*, through the spool 211 and into lines 112 and 113 to the advance chamber 102 and the retard chamber 103, respectively.

Line 119*a* leads to line 145 and to the intermediate lock pin 143. Line 145 further branches into line 132 which leads to the piloted valve 130. The pressure of the fluid in line 119*a* moves through the spool 211 between lands 211*d* and 211*e* into lines 145 to bias the intermediate lock pin 143 against the intermediate lock pin spring 139 to a released position. The fluid in line 145 also flows through line 132 and pressurizes the piloted valve 130 against the spring 131, moving the piloted valve 130 to a position where retard detent line 134, advance detent line 128 and line 129 are blocked and the detent circuit is off. Exhaust line 121 is blocked by spool land 211*d* preventing line 145 from venting. Fluid is also provided from line 119*a* to line 146. Even though the end lock pin 147 is pressurized to lock, the end lock pin 147 cannot lock the housing assembly 100 relative to the rotor assembly 105 since the recess 141 for receiving the end lock pin 147 is only present at an extreme end of travel of the vane 104. Therefore, the end lock pin 147 remains in an unlocked position.

When the duty cycle is 0%, the vane of the phaser is in the mid-position or intermediate phase angle position. The stroke of the spool (position of the spool relative to the sleeve) is 0 mm.

FIG. 13 shows the phaser in the mid-position or intermediate phase angle position, where the duty cycle of the variable force solenoid is 0%, the spool 209 is in detent mode, the piloted valve 130 is vented through the spool to exhaust line 121 leading to sump or exhaust, and the hydraulic detent circuit 233 is open or on.

Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0%, the rotor assembly 105 would move via the detent circuit 233 to the mid-position or intermediate phase angle position, and the intermediate lock pin 143 would be engaged in mid-position or intermediate phase angle position regardless of what position the vane 104 was in relative to the housing assembly 100 prior to the abnormal shut down of the engine.

The ability of the phaser to default to a mid-position or intermediate phase angle position without using electronic controls allows the phaser to move to the mid-position or intermediate phase angle position even during engine cranking when electronic controls are not typically used for controlling the cam phaser position. In addition, since the phaser defaults to the mid-position or intermediate phase angle position, it provides a fail-safe position, especially if control signals or power is lost, that guarantees that the engine will be able to start and run even without active control over the VCT phaser. Since the phaser has the mid-position or intermediate phase angle position upon cranking of the engine, longer travel of the phase of the phaser is possible, providing calibration opportunities. In the prior art, longer travel phasers or a longer phase angle is not possible, since the mid-position or intermediate phase angle position is not present upon engine cranking and startup and the engine has difficulty starting at either the extreme advance or retard stops.

When the duty cycle of the variable force solenoid 107 is just set to 0%, the force on the VFS on the spool 211 is decreased, and the spring 115 moves the spool 211 to the far right end of the spool's travel to a detent mode. Fluid is prevented from flowing from line 119*a* to line 145, line 132 and to the piloted valve 130 by spool land 211*e*. Since fluid cannot flow to lines 145 and 132, the piloted valve 130 vents to exhaust line 121, opening passage between the advance detent line 128 and the retard detent line 134 through the piloted valve 130 to line 129 and the common line 214, in other words, opening or turning on the hydraulic detent circuit 233. With exhaustion of fluid from lines 132 and 145, the intermediate lock pin spring 139 biases the intermediate lock pin 143 to engage the recess 142 in an end plate of the housing assembly 100 and lock the housing assembly 100 relative to the rotor assembly 105. At the same time, fluid is also exhausted from line 146 through exhaust line 121. With fluid exhausting, the end lock pin spring 147 biases the end lock pin 147 to a released, unlocked position.

Fluid also flows from line 119*b* through spool land 211*c*, which restricts oil from supply S to both the advance line 112 and the retard line 113, but allows a continuous small amount of fluid to enter the advance and retard chambers 102, 103. Fluid is prevented from exhausting from the advance chamber 102 and advance line 112 by spool land 211*d*. Fluid is also prevented from exhausting from the retard chamber 103 and retard line 113 by spool land 211*b*, effectively removing control of the phaser from the control valve 209.

Figure 14:
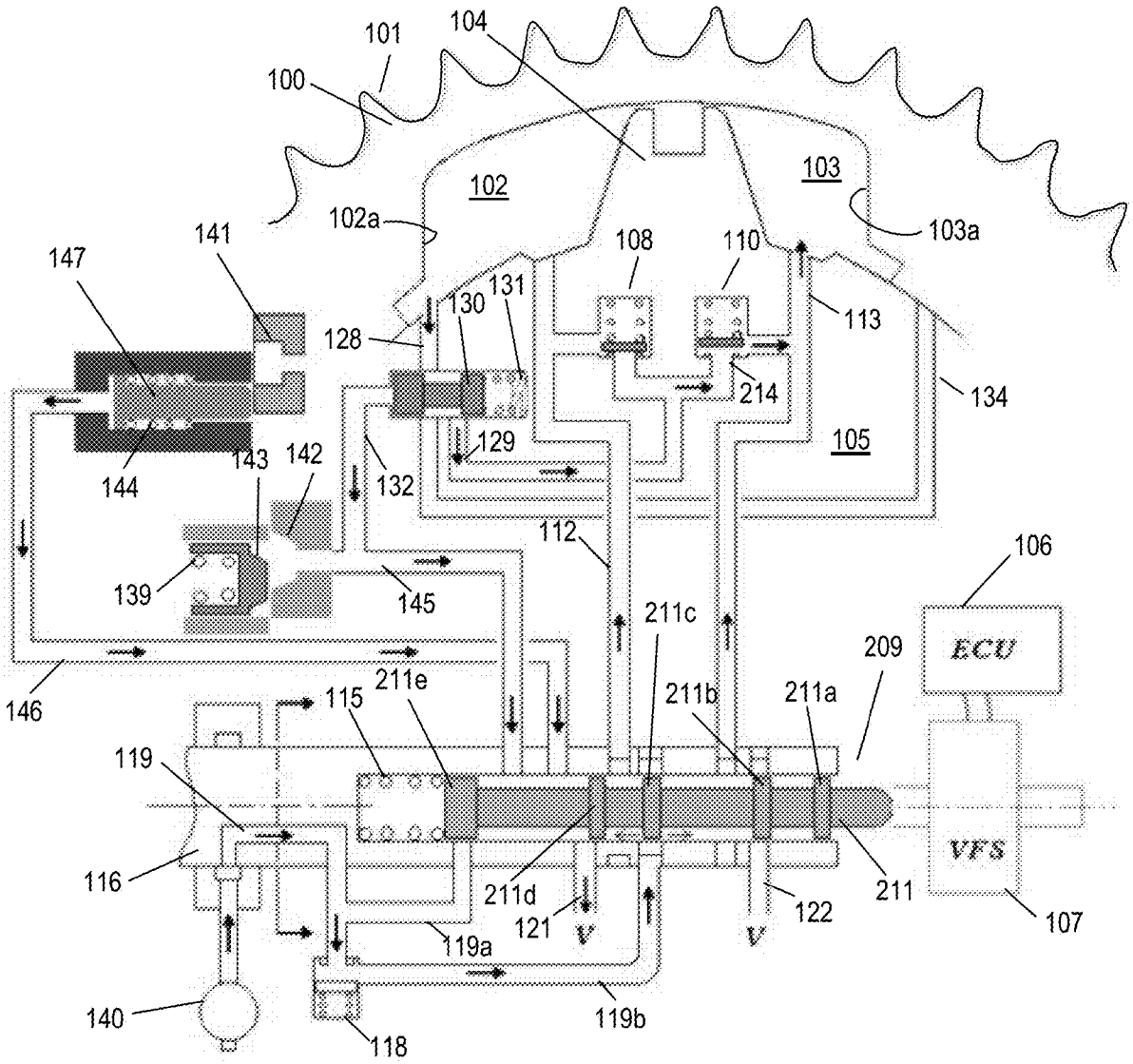
FIG. 14 shows a schematic of a torsion assist (TA) phaser of another alternate embodiment moving from a position in which the advance detent line is exposed to the advance chamber and the intermediate lock pin is unlocked towards a mid-position in which the intermediate lock pin is locked via the hydraulic circuit.

If the vane 104 was positioned within the housing assembly 100 near or in the advance position as shown in FIG. 14, and the advance detent line 128 is exposed to the advance chamber 102, then fluid from the advance chamber 102 will flow into the advance detent line 128 and through the open piloted valve 130 and to line 129 leading to common line 214. From the common line 214, fluid flows through retard check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to a mid-position or intermediate phase angle position within the chamber formed between the housing assembly 100 and the rotor assembly 105.

Figure 15:
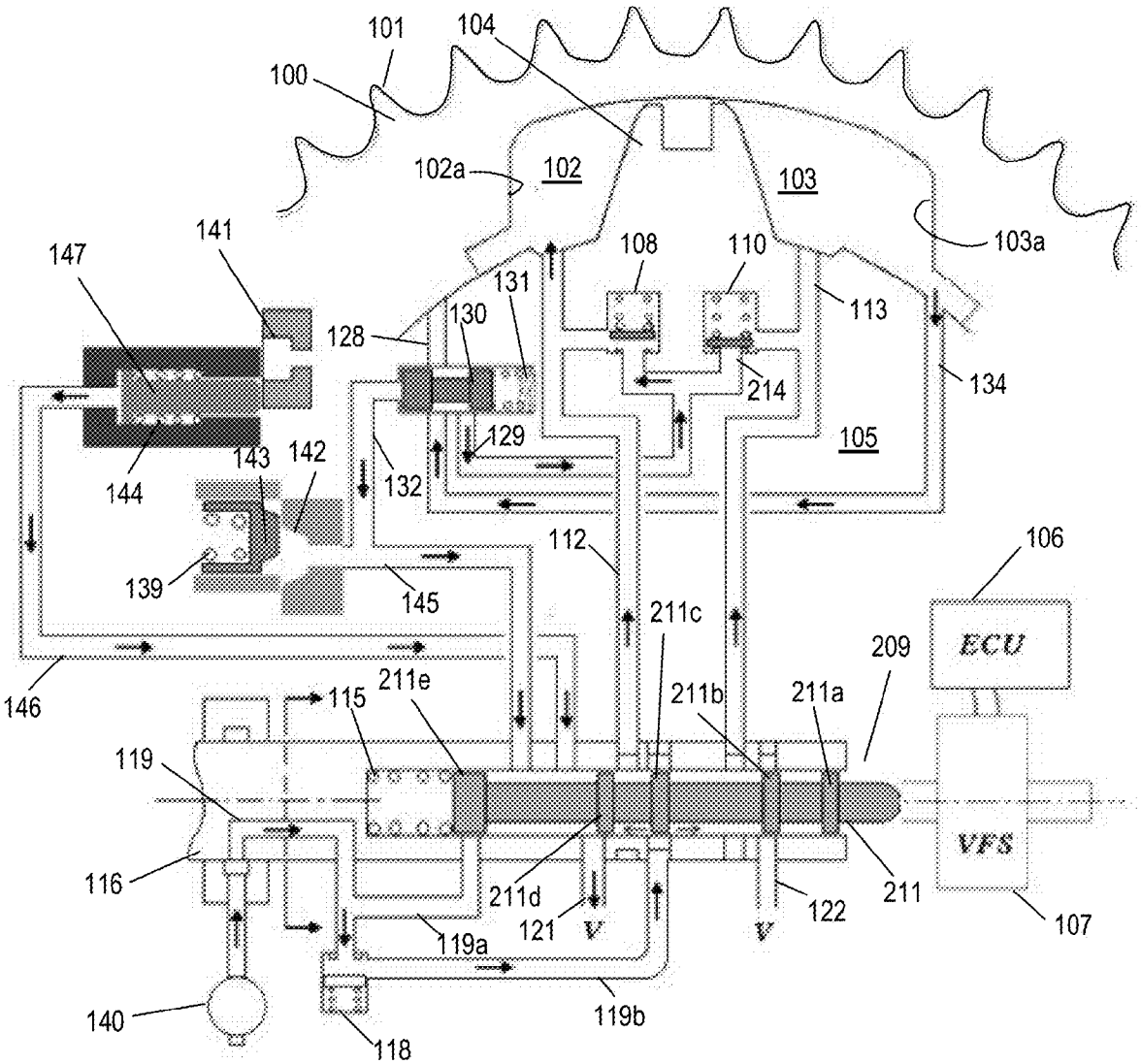
FIG. 15 shows a schematic of a torsion assist (TA) phaser of another alternate embodiment moving from a position in which the retard detent line is exposed to the retard chamber and the intermediate lock pin is unlocked towards a mid-position in which the intermediate lock pin is locked via the hydraulic circuit.

If the vane 104 was positioned within the housing assembly 100 near or in the retard position as shown in FIG. 15, and the retard detent line 134 is exposed to the retard chamber 103, then fluid from the retard chamber 103 will flow into the retard detent line 134 and through the open piloted valve 130 and to line 129 leading to common line 214. From the common line 214, fluid flows through advance check valve 108 and into the advance chamber 102, moving the vane 104 relative to the housing assembly 100 to close off the retard detent line 134 to the retard chamber 103. As the rotor assembly 105 closes off the retard detent line 134 from the retard chamber 103, the vane 104 is moved to a mid-position or intermediate phase angle position within the chamber formed between the housing assembly 100 and the rotor assembly 105.

It should be noted that while the end stop lock mode was described as locking the phaser in a full retard position or retard end stop position, the full retard position may be replaced with a locking of the phaser in a full advance position or advance end stop position. In this position, full advance position is when the vane 104 contacts the retard wall 103*a* or is substantially close to the retard wall 103*a* and may be referred to as an "advance end stop position" of the vane.

FIGS. 16-19 show positions of a cam torque actuated phaser in another embodiment. Torque reversals in the camshaft caused by the forces of opening and closing engine valves move the vane 104. The advance and retard chambers 102, 103 are arranged to resist positive and negative torque pulses in the camshaft and are alternatively pressurized by the cam torque. The control valve 309 allows the vane 104 in the phaser to move by permitting fluid flow from the advance chamber 102 to the retard chamber 103 or vice versa, depending on the desired direction of movement.

The housing assembly 100 of the phaser has an outer circumference 101 for accepting drive force, an inner end plate (not shown) and an outer end plate (not shown). The rotor assembly 105 is connected to the camshaft and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105.

An end lock pin 347 is slidably housed in a bore in the rotor assembly 105 and more preferably in the vane 104. An end portion of the end lock pin 347 is spring biased away from the recess 141 and hydraulically biased towards and fits into a recess 141 in an end plate of the housing assembly 100. The pressurization of the end lock pin 347 is controlled by the movement of the control valve 309.

A control valve 309, preferably a spool valve, includes a spool 311 with cylindrical lands 311*a*, 311*b*, 311*c* slidably received in a sleeve 116. The control valve 309 may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 311 may contact and be influenced by a motor, or other actuators in place of the variable force solenoid 107.

The position of the control valve 309 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 311 is influenced by spring 115 and the solenoid 107 controlled by the ECU 106. Further detail regarding control of the phaser is discussed in detail below. The position of the spool 311 controls the motion (e.g. to move towards the advance position, holding position, the retard position or the retard lock position) of the phaser as well as whether the end lock pin 347 is in a locked or unlocked position. The control valve 309 has an advance mode, a retard mode, a retard lock mode, and a null mode (holding position).

In the advance mode, the spool 311 is moved to a position so that fluid may flow from the retard chamber 103 through the spool 311 to the advance chamber 102, fluid is blocked from exiting the advance chamber 102. The end lock pin 347 is in an unlocked position.

In the retard mode, the spool 311 is moved to a position so that fluid may flow from the advance chamber 102 through the spool 311 to the retard chamber 103, fluid is blocked from exiting the retard chamber 103. The end lock pin 147 is in an unlocked position.

In null mode, the spool 311 is moved to a position that blocks the exit of fluid from the advance and retard chambers 102, 103.

In the retard locking mode or end stop lock mode, the vane 104 has already been moved to a full retard position and flow from the advance chamber 102 through the spool 311 to the retard chamber 103 continues with fluid blocked from exiting the retard chamber 103. In this mode, the end lock pin 347 is pressurized, thus causing the spring 344 to compress and allow the end lock pin 347 to engage the recess 341 of an end plate and move to a locked position. The "full retard position" is defined as when the vane 104 contacts the advance wall 102*a* of the chamber 117 or is substantially close to the advance wall 102*a* and may be referred to as a "retard end stop position" of the vane.

Based on the duty cycle of the pulse width modulated variable force solenoid 107, the spool 311 moves to a corresponding position along its stroke. When the duty cycle of the variable force solenoid 107 is approximately 40%, 60%, and greater than 60%, the spool 311 will be moved to positions that correspond with the retard mode/retard locking mode, the null mode, and the advance mode, respectively. In the retard locking mode or end stop lock mode, the end lock pin 347 is pressurized and engages the recess 341 of an end plate of the housing assembly 100. It should be noted that the duty cycle percentages listed above are an example and they may be altered.

When the duty cycle is set to be greater than 60%, the vane of the phaser is moving toward and/or in an advance position. The stroke of the spool or position of the spool relative to the sleeve is between 3.5 and 5 mm for the advance position.

Figure 16:
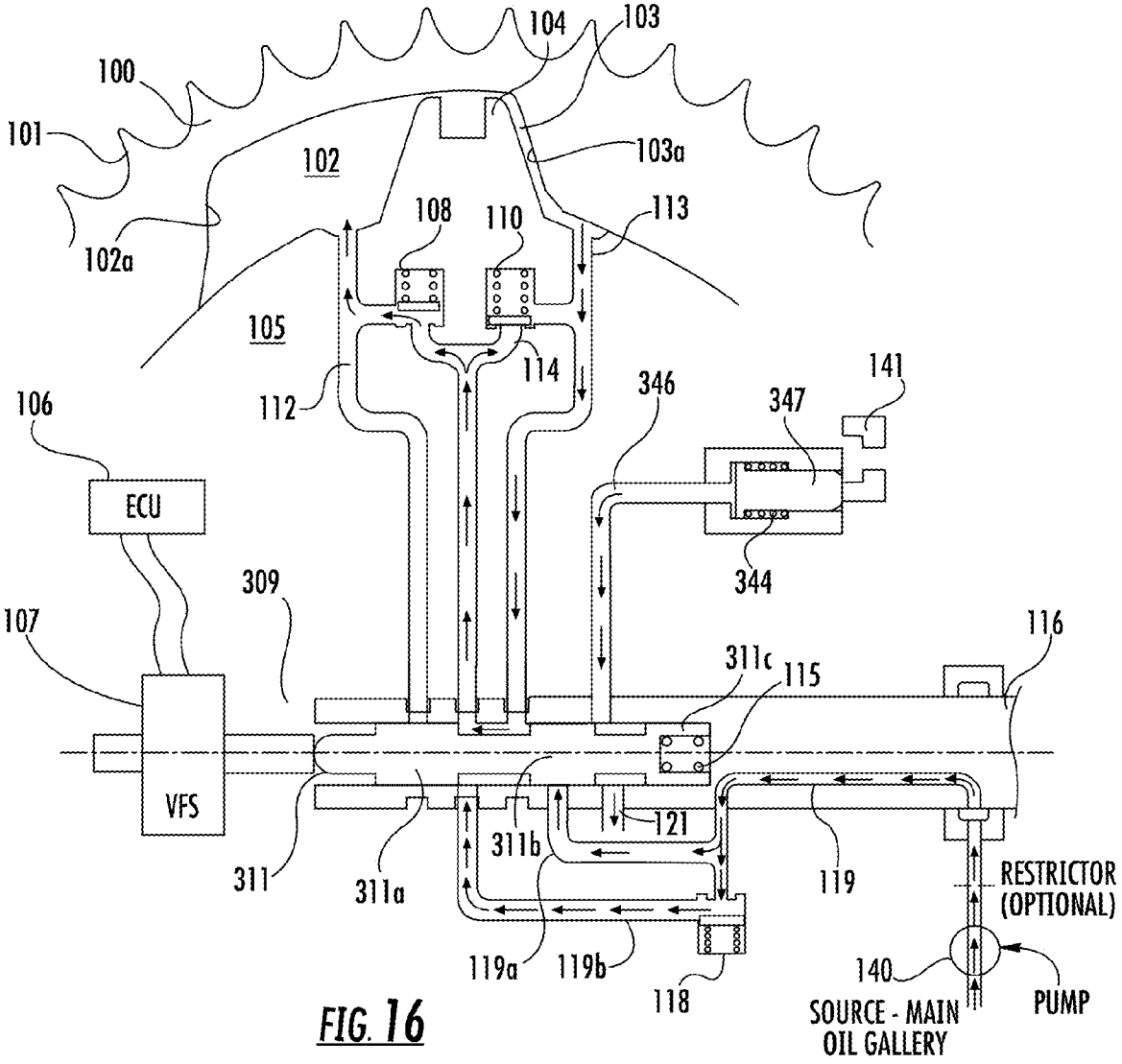
FIG. 16 shows a schematic of a cam torque actuated (CTA) phaser of another embodiment moving towards an advance position.

FIG. 16 shows the phaser moving towards the advance position. To move towards the advance position, the duty cycle is increased to greater than 60%, the force of the VFS 107 on the spool 311 is increased and the spool 311 is moved to the right by the VFS 107 in an advance mode, until the force of the spring 115 balances the force of the VFS 107. In the advance mode shown, spool land 311*a* blocks line 112 and lines 113 and 114 are open. Camshaft torque pressurizes the retard chamber 103, causing fluid to move from the retard chamber 103 and into the advance chamber 102, and the vane 104 to move towards the retard wall 103*a*. Fluid exits from the retard chamber 103 through line 113 to the control valve 309 between spool lands 311*a* and 311*b* and recirculates back to common line 114 and line 112 leading to the advance chamber 102.

Makeup oil is supplied to the phaser from supply S by pump 140 to make up for leakage and enters line 119. If the control valve 309 is in the camshaft, line 119 may be drilled through a bearing. Line 119 splits into two lines 119*a* and 119*b*.

Line 119*a* leads to line 346 and to the end lock pin 347. Line 119*b* leads to an inlet check valve 118 and the control valve 309. From the control valve 309, fluid enters line 114 through the advance check valve 108 and flows to the advance chamber 102.

The pressure of the fluid in line 119*a* is blocked by spool land 311*b* and prevents fluid from line 113 from venting to exhaust line 121. Fluid from line 346 which is in fluid communication with the end lock pin 347 is vented to exhaust line 121 between spool lands 311*b* and 311*c*, such that the end lock pin spring 344 biases the end lock pin 347 out of engagement with the recess 341 and is therefore in an unlocked position. Spool land 311 a prevents any fluid from exhausting from the advance chamber 103 and from line 112.

When the duty cycle is set between 40-60%, the vane of the phaser is moving toward and/or in a retard position. The stroke of the spool or position of the spool relative to the sleeve is between 2 and 3.5 mm for the retard position.

Figure 18:
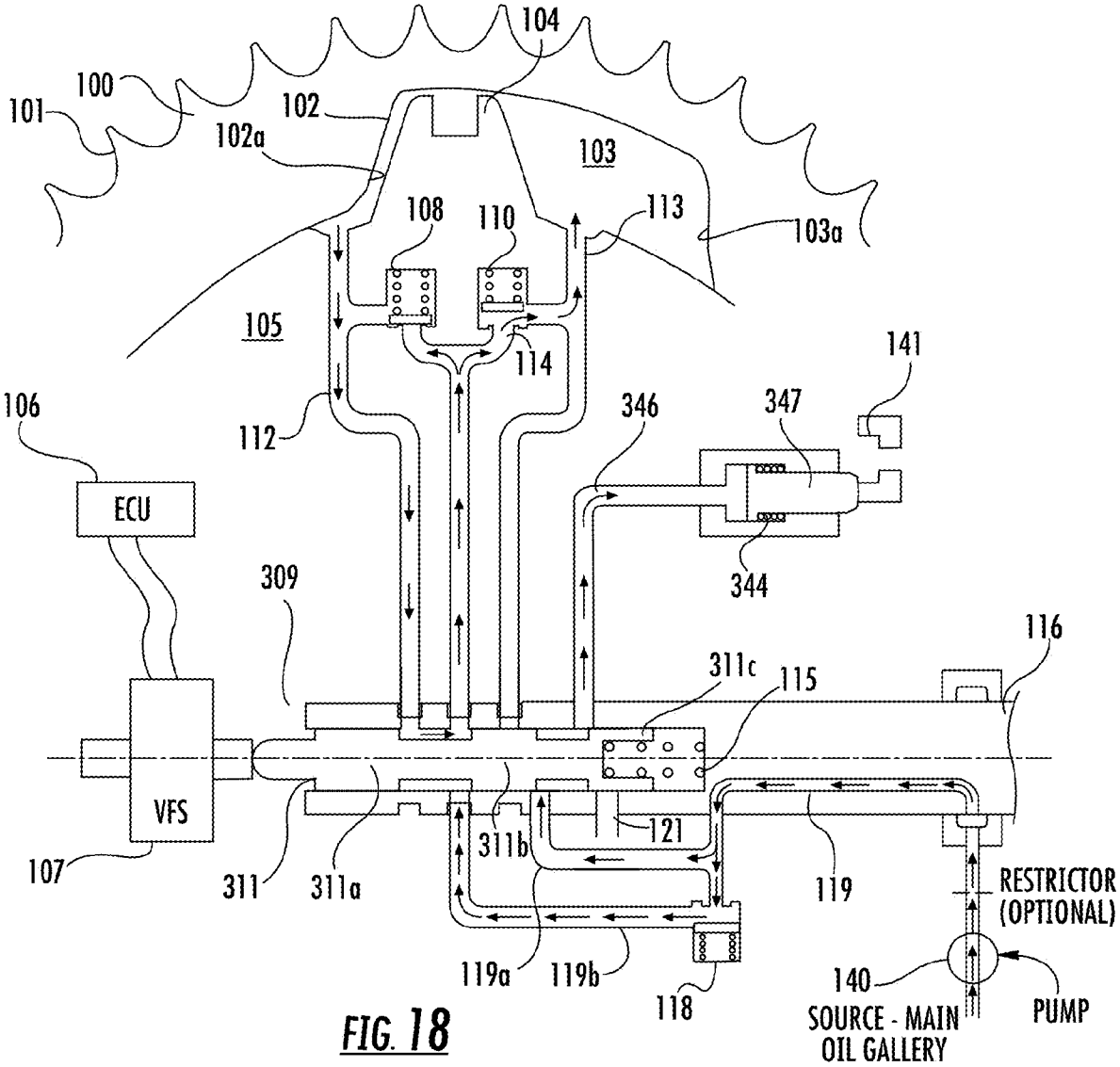
FIG. 18 shows a schematic of cam torque (CTA) phaser of another embodiment moving towards a retard position.

FIG. 18 shows the phaser moving towards the retard position. To move towards the retard position, the duty cycle is changed to greater than 40% but less than 60%, the force of the VFS 107 on the spool 311 is reduced and the spool 311 is moved by spring 115, until the force of spring 115 balances the force of the VFS 107. In the retard mode, spool land 311*b* blocks line 113 and lines 112 and 114 are open. Camshaft torque pressurizes the advance chamber 102, causing fluid in the advance chamber 102 to move into the retard chamber 103, and the vane 104 to move towards the advance chamber wall 102*a*. Fluid exits from the advance chamber 102 through line 112 to the control valve 309 between spool lands 311*a* and 311*b* and recirculates back to common line 114 and line 113 leading to the retard chamber 103.

Makeup oil is supplied to the phaser from supply S by pump 140 to make up for leakage and enters line 119. Line 119 splits into two lines 119*a* and 119*b*. Line 119*a* leads to line 346 to the end lock pin 347. Line 119*b* leads to an inlet check valve 118 and the control valve 309.

From the control valve 309, fluid enters line 114 through the retard check valve 110 and flows to the retard chamber 103. The pressure of the fluid in line 119*a* is blocked by spool land 311*b* and prevents fluid from line 112 from venting to exhaust line 121. Fluid from line 346 is in fluid communication with the end lock pin 347 and is pressurized with fluid from supply 140. It should be noted that the end lock pin 347 is not in a locked position as the recess 341 is not aligned to receive the end of the end lock pin 347. Spool land 311*b* prevents any fluid from exhausting from the retard chamber 103 and from line 113.

When the duty cycle is set between 40-60%, the vane of the phaser is moving toward and/or in a retard locking position. The stroke of the spool or position of the spool relative to the sleeve is approximately 2 mm for the retard locking position.

Figure 17:
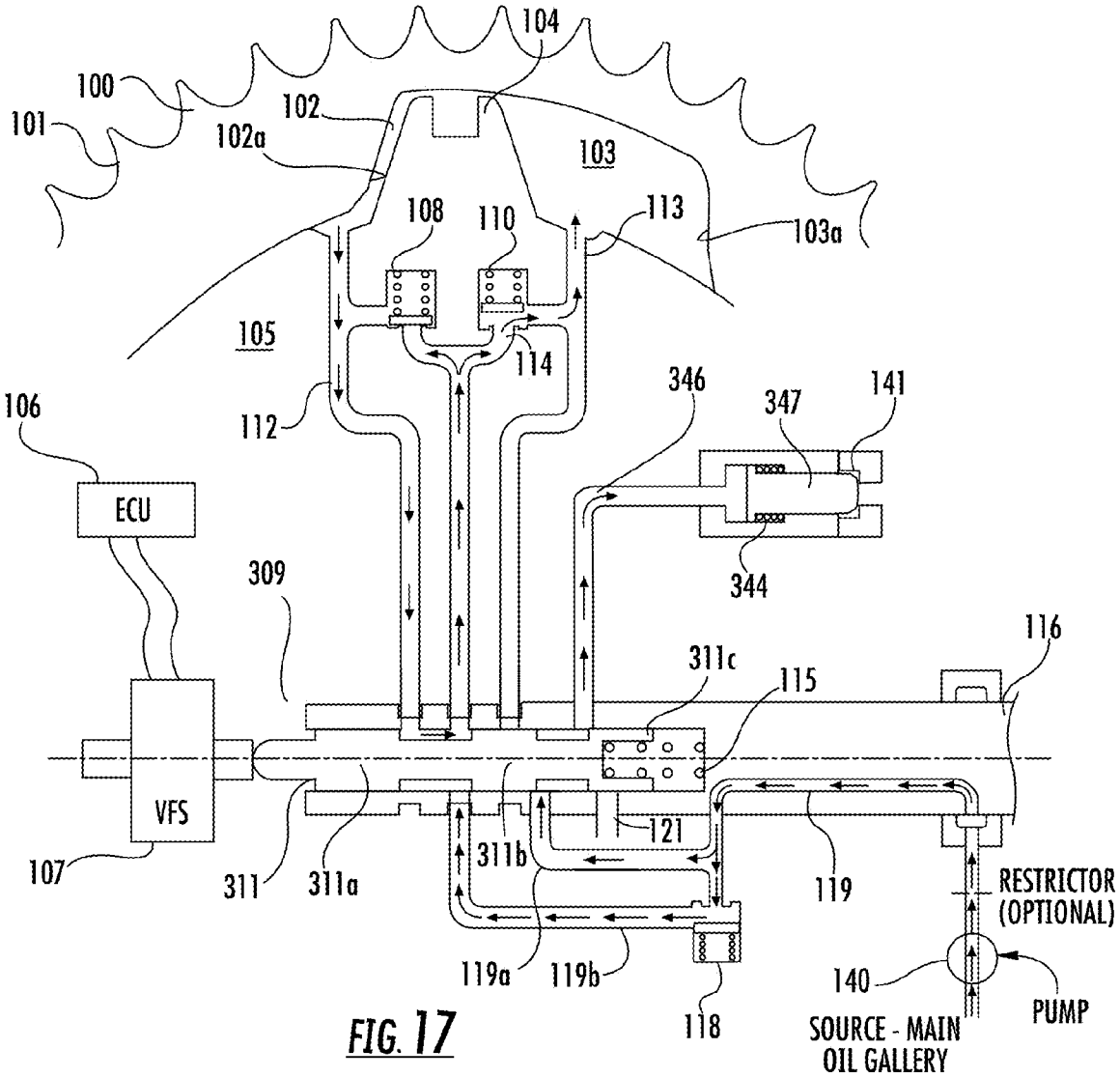
FIG. 17 shows a schematic of a cam torque actuated (CTA) phaser of another embodiment in a retard locked position.

FIG. 17 shows the phaser in the retard locking position at the full retard position or retard end stop position. To move towards the full retard position, the duty cycle is changed to greater than 40% but less than 60%, the force of the VFS 107 on the spool 311 is reduced and the spool 311 is moved to the left in an end stop lock mode in the figure by spring 115, until the force of spring 115 balances the force of the VFS 107. In the end stop lock mode shown, spool land 311*b* blocks line 113 and lines 112 and 114 are open. Camshaft torque pressurizes the advance chamber 102, causing fluid in the advance chamber 102 to move into the retard chamber 103, and the vane 104 to move towards the advance chamber wall 102*a*. Fluid exits from the advance chamber 102 through line 112 to the control valve 309 between spool lands 311*a* and 311*b* and recirculates back to common line 114 and line 113 leading to the retard chamber 103. The phaser is in a full retard position when the vane 104 contacts the advance wall 102*a* or is substantially close the advance wall 102*a* and may be referred to as a "retard end stop position" of the vane.

Makeup oil is supplied to the phaser from supply S by pump 140 to make up for leakage and enters line 119. Line 119 splits into two lines 119*a* and 119*b*. Line 119*b* leads to an inlet check valve 118 and the control valve 309. From the control valve 309, fluid enters line 114 through the retard check valves 110 and flows to the retard chamber 103.

Line 119*a* leads to line 346 and to the end lock pin 347. The fluid in line 346 biases the end lock pin 347 into the recess 341 of an end plate 171 and is in a locked position, locking the housing assembly 100 relative to the rotor assembly 105. Exhaust line 121 is blocked by spool land 311*c* preventing line 346 from venting.

The end lock pin 347 engages or is locked using pressure just prior to engine shutdown, including engine shutdown and customer initiated "key off". During engine cranking, the phaser may be moved to a different starting position than the phaser was locked into just prior to engine shutdown or customer initiated "key off". This can prove to be advantageous for "flex fuel" vehicles in which varying levels of ethanol are present to fuel the vehicle and based on those levels of ethanol, different starting positions of the phaser are advantageous.

The holding position of the phaser preferably takes place between the retard and advance position of the vane relative to the housing. The stroke of the spool or position of the spool relative to the sleeve is 3.5 mm.

Figure 19:
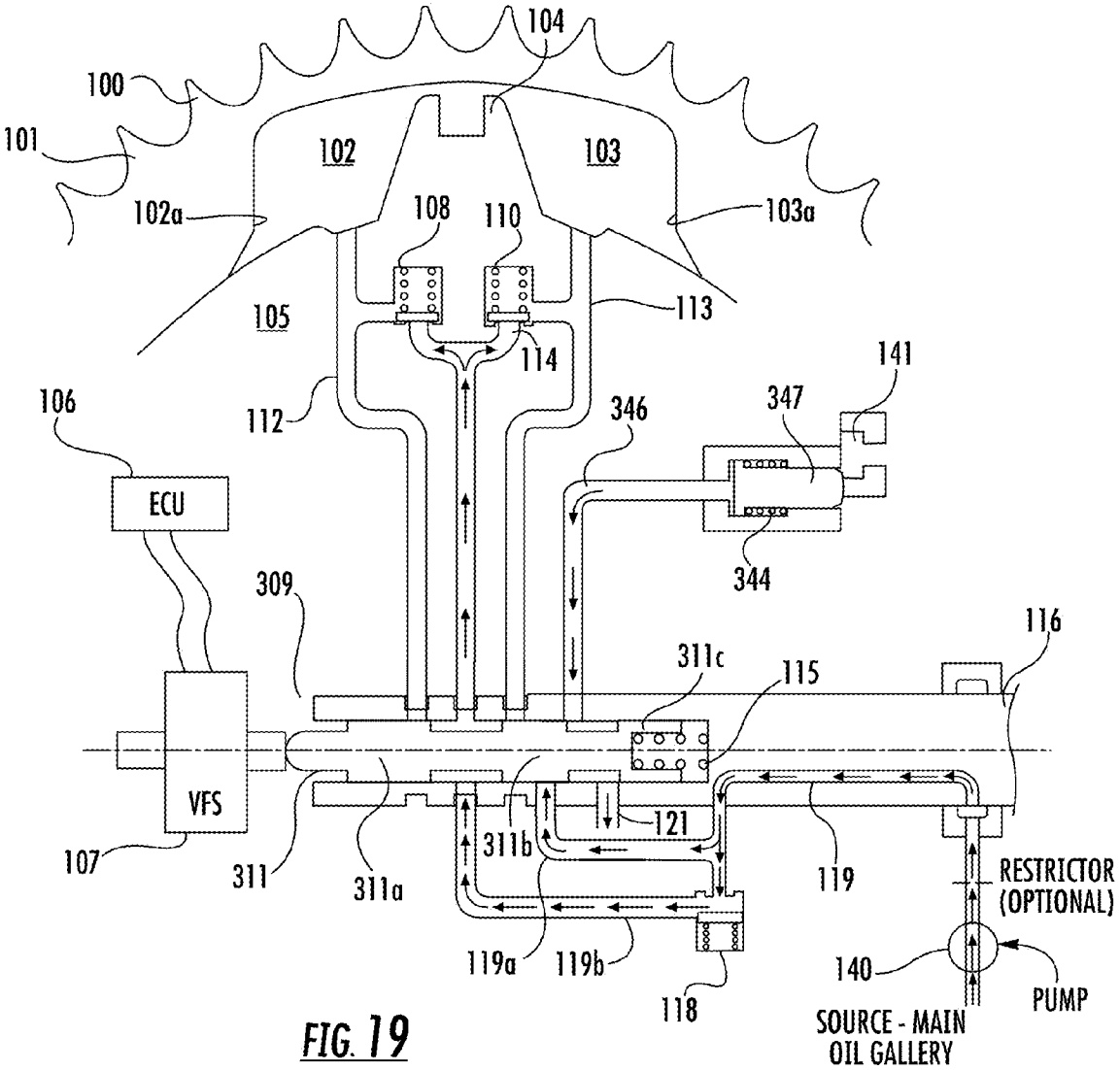
FIG. 19 shows a schematic of a cam torque actuated (CTA) phaser of another embodiment in a holding position.

FIG. 19 shows the phaser in the null position. In this position, the duty cycle of the variable force solenoid 107 is approximately 60% and the force of the VFS 107 on one end of the spool 311 equals the force of the spring 115 on the opposite end of the spool 311 in holding mode. The lands 311*a* and 311*b* block the flow of fluid from lines 112 and 113 respectively. Makeup oil is supplied to the phaser from supply S by pump 140 to make up for leakage and enters line 119.

Line 119 splits into two lines 119*a* and 119*b*. Line 119*b* leads to inlet check valve 118 and the control valve 309. From the control valve 309, fluid enters common line 114 through either of the check valves 108, 110 and flows to the advance or retard chambers 102, 103. Fluid in line 346 vents between spool lands 311*b* and 311*c* through exhaust line 121. The venting of line 346 allows the end lock pin spring 344 to bias the end lock pin 347 away from the recess 341 to an unlocked position.

While FIGS. 14-17 show and describe the end stop lock mode as being in the retard position, the end stop lock mode may also be in the full advance mode when the vane 104 is in contact or substantially in contact with the retard wall 103*a*.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing mechanism for an internal combustion engine, the variable cam timing mechanism having a housing assembly with an outer circumference for accepting drive force and a rotor assembly for connection to a camshaft, having a plurality of vanes coaxially located within the housing assembly, wherein the housing assembly and the rotor assembly define at least one chamber separated by a vane into an advance chamber with an advance wall and a retard chamber with a retard wall opposite the advance wall, the motion of the vane within the at least one chamber acting to shift a relative angular position of the housing assembly and the rotor assembly by fluid by a control valve, the variable cam timing mechanism comprising:

a first lock pin and a second lock pin, each lock pin being slidably located in one of the rotor assembly or the housing assembly, the first lock pin and the second lock pin being movable from an unlocked position in which an end portion does not engage a recess in the other of the rotor assembly or the housing assembly, to a locked position in which the end portion engages the recess, locking the relative angular position of the housing assembly and the rotor assembly at a locked position; the first lock pin being biased by a spring toward the locked position, and the second lock pin being biased by a spring toward the unlocked position;

the locked position of the first lock pin being in an intermediate position between the advance wall and the retard wall;

the locked position of the second lock pin being at an end position when the vane is in a retard end stop position;

a piloted valve movable between a first position to a second position, the piloted valve being biased by a spring into the second position and movable into the first position by fluid pressure;

the control valve being movable into:

an advance mode in which fluid is routed to the advance chamber, the piloted valve and the first lock pin, moving the piloted valve to the first position and the first lock pin to the unlocked position, and fluid is not routed to the second lock pin, such that the second lock pin is moved to the unlocked position by the spring;

a retard mode in which fluid is routed to the retard chamber, the piloted valve, the first lock pin, and the second lock pin moving the piloted valve to the first position and the first lock pin to the unlocked position, and pressurizing the second lock pin to move toward the locked position;

an end stop lock mode in which fluid is routed to the retard chamber, the piloted valve, the first lock pin and the second lock pin, moving the piloted valve to the first position and the first lock pin to the unlocked position, and the second lock pin to the locked position; and a detent mode in which the rotor assembly is moved to and held in an intermediate phase angle position relative to the housing assembly through a plurality of detent lines communicating with the advance chamber or the retard chamber which are restricted or blocked when the rotor assembly is in an intermediate phase angle position, and in which fluid from the control valve is not supplied to the piloted valve causing the piloted valve to move to the second position, and in which fluid is not supplied to either the first lock pin or the second lock pin, such that the first lock pin moves to the locked position and the second lock pin moves to the unlocked position.

2. The variable cam mechanism of claim 1, wherein the control valve is operated by an ECU such that when the internal combustion engine is manually stopped, the control valve is moved to the detent mode.

3. The variable cam mechanism of claim 1, wherein the control valve is operated by an ECU such that when the internal combustion engine is stopped in a stop-start mode, the control valve is moved to the end stop lock mode with the second lock pin in a locked position when the vane is in the retard end stop position.

4. The variable cam mechanism of claim 1, wherein the control valve is movable between the advance mode, the retard mode, the end stop lock mode and the detent mode by a variable force solenoid.

5. The variable cam mechanism of claim 1, wherein the control valve is at an extreme end of travel when in the detent mode.

6. The variable cam mechanism of claim 1, wherein the first lock pin is in the housing assembly and the recess is in the rotor assembly and the second lock pin is in the rotor assembly and the recess is in the housing assembly.

7. The variable cam mechanism of claim 1, wherein the first lock pin is in the rotor assembly and the recess is in the housing assembly and the second lock pin is in the housing assembly and the recess is in the rotor assembly.

8. The variable cam mechanism of claim 1, further comprising an accumulator in fluid communication with the second lock pin.

9. The variable cam mechanism of claim 8, further comprising a check valve in the supply line in fluid communication with the first lock pin and the second lock pin.

10. The variable cam mechanism of claim 1, in which the end stop lock mode locks the mechanism at a full retard position when the vane is in the retard end stop position.

11. The variable cam mechanism of claim 1, wherein when the control valve is in the advance mode, the retard mode, and the end stop lock mode, the variable cam timing mechanism is operated by engine oil pressure.

12. The variable cam mechanism of claim 1, wherein when the control valve is in the advance mode, the retard mode, the end stop lock mode and the detent mode, the variable cam mechanism is operated by cam torque.

13. The variable cam mechanism of claim 1, wherein the piloted valve is in the rotor assembly.

14. The variable cam mechanism of claim 1, wherein the piloted valve is located remotely from the variable cam mechanism.

15. A variable cam timing mechanism for an internal combustion engine, the variable cam timing mechanism having a housing assembly with an outer circumference for accepting drive force and a rotor assembly for connection to a camshaft, having a plurality of vanes coaxially located within the housing assembly, wherein the housing assembly and the rotor assembly define at least one chamber separated by a vane into an advance chamber with an advance wall and a retard chamber with a retard wall opposite the advance wall, the motion of the vane within the at least one chamber acting to shift a relative angular position of the housing assembly and the rotor assembly by fluid from a control valve, the variable cam timing mechanism comprising:

a first lock pin and a second lock pin, each lock pin being slidably located in one of the rotor assembly or the housing assembly, the first lock pin and the second lock pin being movable from an unlocked position in which an end portion does not engage a recess in the other of the rotor assembly or the housing assembly, to a locked position in which the end portion engages the recess, locking the relative angular position of the housing assembly and the rotor assembly at a locked position; the first lock pin being biased by a spring toward the locked position, and the second lock pin being biased by a spring toward the unlocked position;

the locked position of the first lock pin being in an intermediate position between the advance wall and the retard wall;

the locked position of the second lock pin being at an end position when the vane is in an advance end stop position;

a piloted valve movable between a first position to a second position, the piloted valve being biased by a spring into the second position and movable into the first position by fluid pressure;

the control valve being movable into:

an advance mode in which fluid is routed to the advance chamber, the piloted valve, the first lock pin, and the second lock pin, moving the piloted valve to the first position and the first lock pin to the unlocked position, and pressurizing the second lock pin to move toward the locked position;

a retard mode in which fluid is routed to the retard chamber, the piloted valve and the first lock pin, moving the piloted valve to the first position and the first lock pin to the unlocked position, and fluid is not routed to the second lock pin, such that the second lock pin is moved to the unlocked position by the spring;

an end stop lock mode in which fluid is routed to the advance chamber, the piloted valve, the first lock pin and the second lock pin, moving the piloted valve to the first position and the first lock pin to the unlocked position, and the second lock pin to the locked position; and a detent mode in which the rotor assembly is moved to and held in an intermediate phase angle position relative to the housing assembly through a plurality of detent lines communicating with the advance chamber or the retard chamber which are restricted or blocked when the rotor assembly is in intermediate phase angle position, and in which fluid from the control valve is not supplied to the piloted valve causing the piloted valve to move to the second position, and in which fluid is not supplied to either the first lock pin or the second lock pin, such that the first lock pin moves to the locked position and the second lock pin moves to the unlocked position.

16. The variable cam mechanism of claim 15, wherein the control valve is operated by an ECU such that when the internal combustion engine is manually stopped, the control valve is moved to the detent mode.

17. The variable cam mechanism of claim 15, wherein the control valve is operated by an ECU such that when the internal combustion engine is stopped in a stop-start mode, the control valve is moved to the end stop lock mode with the second lock pin in a locked position when the vane is in the advance end stop position.

18. The variable cam mechanism of claim 15, wherein the control valve is movable between the advance mode, the retard mode, the end stop lock mode and the detent mode by a variable force solenoid.

19. The variable cam mechanism of claim 15, wherein the control valve is at an extreme end of travel when in detent mode.

20. The variable cam mechanism of claim 15, wherein the first lock pin is in the housing assembly and the recess is in the rotor assembly and the second lock pin is in the rotor assembly and the recess is in the housing assembly.

21. The variable cam mechanism of claim 15, wherein the first lock pin is in the rotor assembly and the recess is in the housing assembly and the second lock pin is in the housing assembly and the recess is in the rotor assembly.

22. The variable cam mechanism of claim 15, further comprising an accumulator in fluid communication with the second lock pin.

23. The variable cam mechanism of claim 22, further comprising a check valve in the supply line in fluid communication with the first lock pin and the second lock pin.

24. The variable cam mechanism of claim 15, in which the end stop lock mode locks the mechanism at a full advance position when the vane is in the advance end stop position.

25. The variable cam mechanism of claim 15, wherein when the control valve is in the advance mode, the retard mode, and the end stop lock mode, the variable cam timing mechanism is operated by engine oil pressure.

26. The variable cam mechanism of claim 15, wherein when the control valve is in the advance mode, the retard mode, the end stop lock mode and the detent mode, the variable cam mechanism is operated by cam torque.

27. The variable cam mechanism of claim 15, wherein the piloted valve is in the rotor assembly.

28. The variable cam mechanism of claim 15, wherein the piloted valve is located remotely from the variable cam mechanism.

29. A variable cam timing mechanism for an internal combustion engine, the variable cam timing mechanism having a housing assembly with an outer circumference for accepting drive force and a rotor assembly for connection to a camshaft, having a plurality of vanes coaxially located within the housing assembly, wherein the housing assembly and the rotor assembly define at least one chamber separated by a vane into an advance chamber with an advance wall and a retard chamber with a retard wall opposite the advance wall, the motion of the vane within the at least one chamber acting to shift a relative angular position of the housing assembly and the rotor assembly by fluid from a control valve and by cam torque, the mechanism comprising:

an end lock pin slidably located in one of the rotor assembly or the housing assembly, the end lock pin being movable from an unlocked position in which an end portion does not engage a recess in the other of the rotor assembly or the housing assembly, to a locked position in which the end portion engages the recess, locking the relative angular position of the housing assembly and the rotor assembly at a locked position; the end lock pin being biased by a spring toward the unlocked position;

the locked position of the end lock pin being at an end position when the vane is in a retard end stop position;

the control valve being movable into:

an advance mode in which fluid is routed to the advance chamber and fluid is not routed to the end lock pin, such that the end lock pin is moved to the unlocked position by the spring;

a retard mode in which fluid is routed to the retard chamber and pressurizes the end lock pin to move toward the locked position; and an end stop lock mode in which fluid is routed to the retard chamber and the end lock pin is in the locked position.

30. The variable cam mechanism of claim 29, wherein the control valve is operated by an ECU such that when the internal combustion engine is stopped in a stop-start mode, the control valve is moved to the end stop lock mode with the end lock pin in a locked position when the vane is in the retard end stop position.

31. The variable cam mechanism of claim 29, wherein the control valve is movable between the advance mode, the retard mode and the end stop lock mode by a variable force solenoid.

32. The variable cam mechanism of claim 29, wherein the end lock pin is in the housing assembly and the recess is in the rotor assembly.

33. The variable cam mechanism of claim 29, wherein the end lock pin is in the rotor assembly and the recess is in the housing assembly.

34. The variable cam mechanism of claim 29, further comprising a check valve in the supply line in fluid communication with the end lock pin.

35. The variable cam mechanism of claim 29, in which the end stop lock mode locks the mechanism at a full retard position when the vane is in the retard end stop position.

* * * * *